US009895894B2

(12) United States Patent
Taira et al.

(10) Patent No.: US 9,895,894 B2
(45) Date of Patent: Feb. 20, 2018

(54) INK JET PRINTING APPARATUS AND INK JET PRINTING METHOD

(71) Applicant: CANON KABUSHIKI KAISHA, Tokyo (JP)

(72) Inventors: Hiroshi Taira, Fuchu (JP); Taku Yokozawa, Yokohama (JP); Hiroaki Shirakawa, Kawasaki (JP); Mitsutoshi Nagamura, Tokyo (JP); Yuhei Oikawa, Yokohama (JP); Satoshi Azuma, Kawasaki (JP); Yosuke Ishii, Kawasaki (JP); Hiroaki Komatsu, Fuji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/156,701

(22) Filed: May 17, 2016

(65) Prior Publication Data

US 2016/0339692 A1 Nov. 24, 2016

(30) Foreign Application Priority Data

May 19, 2015 (JP) ..... 2015-102292

(51) Int. Cl.
*B41J 2/045* (2006.01)
*B41J 2/165* (2006.01)
*B41J 2/14* (2006.01)

(52) U.S. Cl.
CPC ..... *B41J 2/16526* (2013.01); *B41J 2/14153* (2013.01); *B41J 2002/16573* (2013.01)

(58) Field of Classification Search
CPC ..... B41J 2/145; B41J 2/2054; B41J 19/142
See application file for complete search history.

(56) References Cited

U.S. PATENT DOCUMENTS

| | | | | |
|---|---|---|---|---|
| 7,896,466 | B2 * | 3/2011 | Murayama | B41J 2/21 347/15 |
| 8,272,710 | B2 * | 9/2012 | Spaulding | B41J 19/142 347/15 |
| 2008/0246793 | A1 * | 10/2008 | Seki | B41J 2/2107 347/15 |
| 2012/0194614 | A1 * | 8/2012 | Marumoto | B41J 19/142 347/37 |
| 2013/0182042 | A1 * | 7/2013 | Uchida | B41J 2/2132 347/43 |
| 2013/0241997 | A1 * | 9/2013 | Teshigawara | G03G 15/104 347/41 |
| 2015/0343764 | A1 * | 12/2015 | Kobayashi | B41J 2/04535 347/12 |

FOREIGN PATENT DOCUMENTS

| | | |
|---|---|---|
| JP | H08-039825 A | 2/1996 |
| JP | 2011-025693 A | 2/2011 |

* cited by examiner

*Primary Examiner* — Stephen Meier
*Assistant Examiner* — John P Zimmermann
(74) *Attorney, Agent, or Firm* — Canon U.S.A., Inc. IP Division

(57) ABSTRACT

After printing is performed by driving only some printing elements, the other printing elements are driven so that kogation is deposited on the surface of the other printing elements.

10 Claims, 28 Drawing Sheets

FIG. 25

| | ACCUMULATION OF AVERAGE VALUES OF NUMBER OF EJECTION TIMES | | | | | |
|---|---|---|---|---|---|---|
| EJECTION SPEED VARIATION RATE | 2.0E+07 | 4.0E+07 | 6.0E+07 | 8.0E+07 | 1.0E+08 | 1.2E+08 |
| 0% ≤ VARIATION RATE < 10% | 0 | 0 | 0 | 0 | 0 | 0 |
| 10% ≤ VARIATION RATE < 20% | 0.5 | 0.3 | 0.2 | 0 | 0 | 0 |
| 20% ≤ VARIATION RATE < 30% | 0.5 | 0.5 | 0.3 | 0.2 | 0 | 0 |
| 30% ≤ VARIATION RATE < 40% | 0.5 | 0.5 | 0.5 | 0.3 | 0 | 0 |
| 40% ≤ VARIATION RATE < 50% | 0.5 | 0.5 | 0.5 | 0.4 | 0.1 | 0 |
| 50% ≤ VARIATION RATE | 0.5 | 0.5 | 0.5 | 0.4 | 0.2 | 0 |

INK JET PRINTING APPARATUS AND INK JET PRINTING METHOD

BACKGROUND OF THE INVENTION

Field of the Invention

The present invention relates to an ink jet printing apparatus and an ink jet printing method.

Description of the Related Art

Ink jet printing apparatuses have been known which print images by repeatedly performing print scanning in which ink is ejected to a unit region of a printing medium by driving printing elements while relatively moving a printing head including a printing element array in which a plurality of printing elements which generate thermal energy for ejecting ink are arranged, and sub scanning in which the printing medium is conveyed. Such ink jet printing apparatuses of a so-called multipass printing method for forming images by performing a plurality of print scanning operations for a unit region has been known.

With such ink jet printing apparatuses of the multipass printing method, it has been known that printing is performed by using only some of the plurality of printing elements in the printing element array. For example, Japanese Patent Laid-Open No. 2011-025693 discloses a technique for performing printing by driving only printing elements which eject ink to a unit region in latter-half scanning for a printing element array which ejects ink containing color materials and driving only printing elements which eject ink to a unit region in former-half scanning for a printing element array which ejects ink not containing color materials. With such a printing method, ink ejection may be controlled such that ink not containing color materials can be provided to a printing medium earlier than ink containing color materials.

Meanwhile, with ink jet printing apparatuses which eject ink by thermal energy, it has been known that ink kogation occurs by thermal energy at driving of a printing element and the kogation is deposited on the surface of the printing element. In the case where such deposition of kogation occurs, the ejection characteristics including the ejection speed and the ejection amount of ink from the corresponding printing element differ from those of a printing element on which kogation is not deposited. In the case where the number of driving times varies among a plurality of printing elements in a printing element array, such as, for example, in the case where only some of the plurality of printing elements are driven as described above, the amount of kogation deposited varies among the printing elements after printing is performed. If printing is performed again by driving both the printing element on which kogation is deposited and the printing element on which kogation is not deposited in a state in which nonuniformity of kogation occurs, the quality of an image obtained may be degraded by the above-mentioned variations in the ejection characteristics.

Japanese Patent Laid-Open No. 8-039825 describes a technique for performing so-called aging processing in which the number of driving times is counted for each printing element, and the printing element is driven for each printing element in accordance with the counted number of driving times after printing is performed, so that uniformization is achieved for kogation discharge and smooth application of ink. According to the technique described in Japanese Patent Laid-Open No. 8-039825, a larger number of driving times in the aging processing is required for a printing element with a smaller number of driving times at the time of printing. By performing such aging processing, the ejection amount may become uniform among a plurality of printing elements within a printing element array. Therefore, a degradation in the image quality caused by variations in the above-mentioned ejection characteristics may be suppressed.

However, in the technique described in Japanese Patent Laid-Open No. 8-039825, the number of driving times at the time of printing is counted for each of a plurality of printing elements within a printing element array, and the number of driving times of aging is determined for each printing element. Therefore, in the case where a large number of printing elements form a printing element array or a large number of printing element arrays are used, the load of data processing increases in order to count the number of driving times of each printing element.

Furthermore, in the case where printing is performed using the technique described in Japanese Patent Laid-Open No. 2011-025693, the degree of kogation is not uniform between a printing element for which driving is defined and a printing element for which non-driving is defined. Meanwhile, nonuniformity of the degree of kogation among printing elements for which driving is defined is not very significant, and therefore a degradation in the image quality among the printing elements driven is not noticeable. However, according to the technique described in Japanese Patent Laid-Open No. 8-039825, the number of driving times for aging is calculated from the number of driving times for each printing element even for the printing elements for which driving is defined, and therefore the load required for data processing may unnecessarily increase.

SUMMARY OF THE INVENTION

The present invention performs processing for reducing nonuniformity of kogation among printing elements while reducing the load of data processing in a case where printing is performed by driving only some of a plurality of printing elements within a printing element array.

According to an example of the present invention, An ink jet printing apparatus that prints an image by ejecting ink to a printing medium, includes a printing head configured to include a printing element array in which a plurality of printing elements for generating thermal energy for ejecting ink are arranged in a predetermined direction; a scanning unit configured to cause the printing head to perform scanning for a unit region on the printing medium relatively in a cross direction which crosses the predetermined direction; a selection unit configured to select one of a plurality of printing modes which include at least a first printing mode in which printing is performed by driving a predetermined number of first printing elements among the plurality of printing elements arranged in the printing element array and not driving a predetermined number of second printing elements which are different from the predetermined number of first printing elements, and a second printing mode in which printing is performed by driving at least the predetermined number of first printing elements and the predetermined number of second printing elements; a first controller configured to perform control such that, with the scanning of the printing head by the scanning unit, printing is performed for the unit region in accordance with the printing mode which is selected by the selection unit; a first acquisition unit configured to acquire information regarding the number of driving times of the predetermined number of first printing elements in the printing by the first controller; and a second controller configured to perform, in a case where the first printing mode is selected by the selection unit, when ejection of ink by the first controller is not performed, control to drive the predetermined number of second printing elements. The second controller drives the predetermined number of second printing elements in such a manner that the number of driving times of the predetermined number of second printing elements in a case where the number of driving times indicated by the information acquired by the first acquisition unit is equal to a first number of times is greater than the number of driving times of the predetermined number of second printing elements in a case where the number of driving times indicated by the information acquired by the first acquisition unit is equal to a second number of times that is smaller than the first number of times.

Further features of the present invention will become apparent from the following description of exemplary embodiments with reference to the attached drawings.

BRIEF DESCRIPTION OF THE DRAWINGS

FIG. 25 is a diagram illustrating the correlation between ejection speed and accumulation of the average values of the number of ejection times.

DESCRIPTION OF THE EMBODIMENTS

Hereinafter, a first embodiment of the present invention will be described in detail with reference to drawings.

First Embodiment

Figure 1:
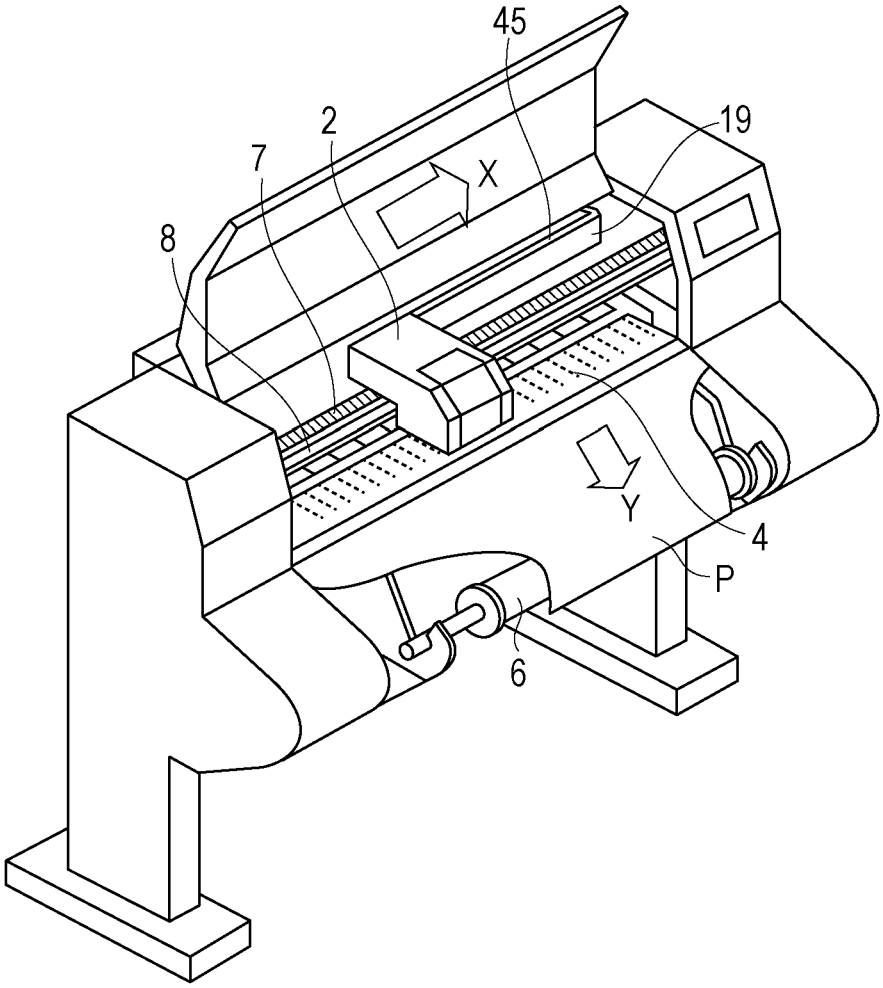
FIG. 1 is a perspective view of an image printing apparatus according to an embodiment.

FIG. 1 illustrates the outer appearance of an ink jet printing apparatus (hereinafter, may also be referred to as a printer) according to a first embodiment. The ink jet printing apparatus is a so-called serial-scanning printer and prints images by relatively scanning a printing head in a cross direction (X direction) that is orthogonal to a conveyance direction (Y direction) of a printing medium P.

A configuration of the ink jet printing apparatus and the outline of an operation at the time of printing will be described with reference to FIG. 1. First, the printing medium P is conveyed in the Y direction by a spool 6 which holds the printing medium P by a conveyance roller which is driven via a gear by a conveyance motor, which is not illustrated in FIG. 1. Meanwhile, a carriage unit 2 is scanned with a carriage monitor, which is not illustrated in FIG. 1, at a predetermined conveyance position, along a guide shaft 8 which extends in the X direction. Then, in the course of scanning, an ejecting operation is performed through an ejection port of a printing head (described later) which may be mounted at the carriage unit 2 at a timing based on a position signal obtained by an encoder 7, and a certain bandwidth which corresponds to the arrangement range of the ejection port is printed. In this embodiment, scanning is performed at a scanning speed of 40 inches per second, and an ejecting operation is performed at a resolution of 600 dpi (1/600 inches). After that, the printing medium P is conveyed, and printing of the next bandwidth is performed.

A carriage belt may be used for transmitting driving force from the carriage motor to the carriage unit 2. However, instead of the carriage belt, other driving systems such as, for example, a device including a lead screw which is driven to rotate by the carriage motor and extends in the X direction and an engaging part which is provided at the carriage unit 2 and is engaged with a groove of the lead screw, may be used.

The supplied printing medium P is clamped between a paper feeding roller and pinching roller and conveyed to a printing position on a platen 4 (a main-scanning region of a printing head). In a normal stop state, capping is applied onto an orifice face of the printing head. Therefore, the cap is removed prior to printing so that the printing head or the carriage unit 2 may enter a scanning possible state. After that, when data for a single scanning operation is stored in a buffer, scanning of the carriage unit 2 is performed by the carriage motor, and printing is performed as described above.

A flexible printed circuit board 19 for supplying driving pulses and head temperature adjustment signals for ejection driving is mounted is mounted on a printing head. The other end of the flexible board is connected to a controller (not illustrated in FIG. 2) which includes a control circuit such as a central processing unit (CPU) for executing control of the printer. Furthermore, a thermistor (not illustrated in FIG. 2), which is a temperature sensor for detecting the ambient temperature inside the ink jet printing apparatus, is provided near the controller.

Figure 2:
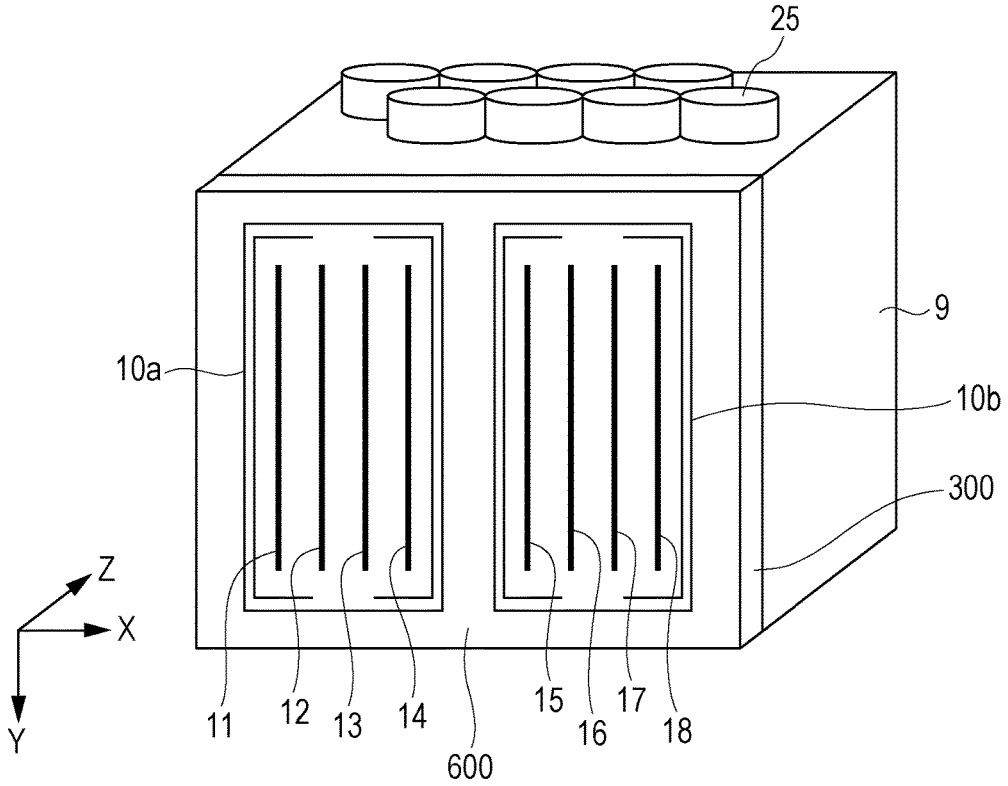
FIG. 2 is a schematic diagram of a printing head according to an embodiment.

FIG. 2 is a perspective view schematically illustrating a printing head 9 according to this embodiment.

The printing head 9 used in this embodiment is able to eject ink of eight types in total: color ink of seven types containing pigment as color materials, that is, cyan ink, magenta ink, yellow ink, black ink, gray ink, red ink, and blue ink; and clear ink not containing color materials. The clear ink is used to improve the image characteristics of color ink by being added over a layer of the color ink formed on a printing medium.

Joint parts 25 are formed at the printing head 9, and ink supply tubes described above are connected to the joint parts 25.

Furthermore, two printing element boards 10*a* and 10*b* formed of a semiconductor or the like are mounted on an ejection port formation face of the printing head 9 which is a face opposite the printing medium P. Ejection port arrays are formed on each of the printing element boards 10*a* and 10*b*, along the Y direction that is orthogonal to the X direction. In more detail, an ejection port array 11 for ejecting black (Bk) ink, an ejection port array 12 for ejecting gray (Gy) ink, an ejection port array 13 for ejecting blue (B) ink, and an ejection port array 14 for ejecting red (R) ink are arranged in the X direction on the printing element board 10*a*. Furthermore, an ejection port array 15 for ejecting cyan (C) ink, an ejection port array 16 for ejecting magenta (M) ink, an ejection port array 17 for ejecting yellow (Y) ink, and an ejection port array 18 for ejecting clear (Cl) ink are arranged in the X direction on the printing element board 10*b*.

Furthermore, at positions within the printing element boards 10*a* and 10*b* that face the ejection port arrays 11 to 18, printing element arrays are formed as described later. In the description provided below, for the sake of simplification, the printing element arrays located at positions that face the ejection port arrays 11 to 18 will be referred to as printing element arrays 11*x* to 18*x*, respectively.

The printing element boards 10*a* and 10*b* are fixed at a supporting member 300 formed of alumina, resin, or the like, using an adhesive. Furthermore, the printing element boards 10*a* and 10*b* are electrically connected to an electric wiring member 600 on which wiring is provided, and communicate with the printing head 9 via the electric wiring member 600 using signals.

Figure 3A:
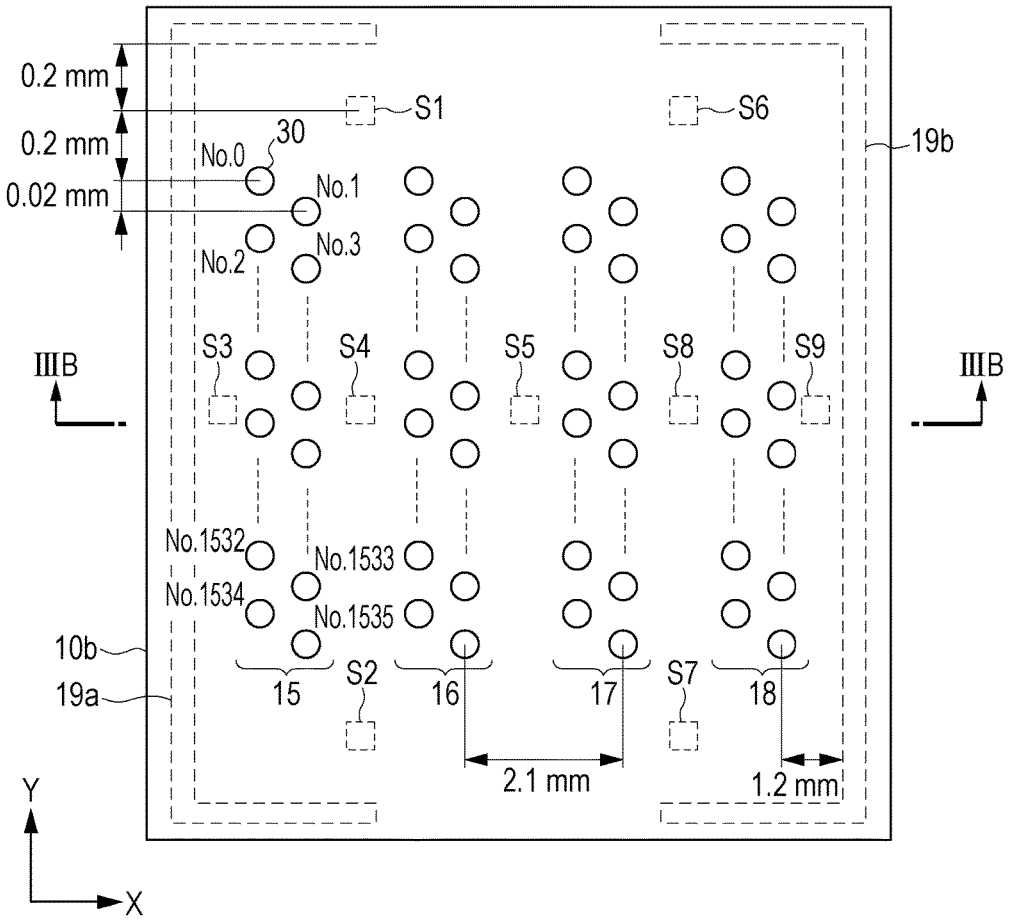
FIGS. 3A and 3B are see-through diagrams of a printing head according to an embodiment.
Figure 3B:
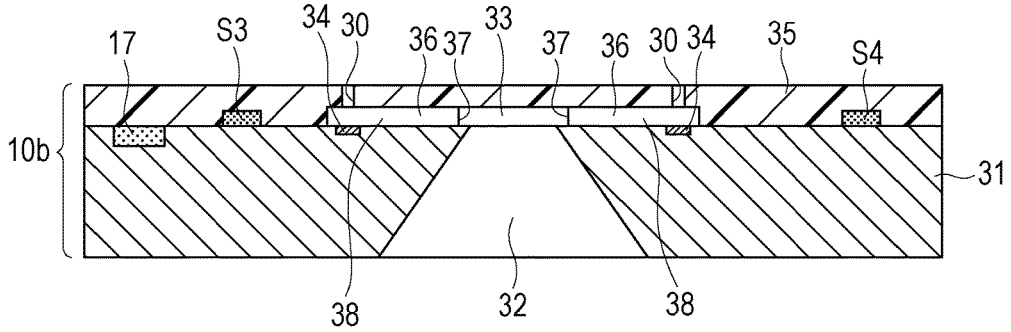

FIG. 3A is a see-through diagram in a case where the printing element board 10*b* is viewed from a direction perpendicular to the X-Y plane. FIG. 3B is a cross-sectional view in a case where a state near the ejection port array 15 on a cross section obtained when the printing element board 10*b* is taken along a segment IIIB-IIIB illustrated in FIG. 3A and cut perpendicularly to the printing element board 10*b* is viewed from a downstream side in the Y direction. In FIGS. 3A and 3B, for the sake of simplification, the dimension ratio of individual units differs from the actual dimension ratio. The actual size of the printing element board 10*b* is 9.55 mm in the X direction and 39.0 mm in the Y direction.

The ejection port arrays 11 to 18 in this embodiment each include two lines. The two lines face each other with a shift from each other by one dot at 1,200 dpi (dot/inch), and each line includes 768 ejection ports 30 and 768 printing elements (hereinafter, may also be referred to as main heaters) 34, which are electro-thermal conversion elements facing the ejection ports 30, in the Y direction (array direction), that is, 1,536 ejection ports 30 and 1,536 printing elements 34 are arranged in the Y direction (predetermined direction). In this embodiment, 1,200 dpi corresponds to about 0.02 mm. By applying pulses to the printing elements, thermal energy for ejecting ink from the ejection ports may be generated. Although the case where an electro-thermal conversion element is used as a printing element has been described above, a piezoelectric transducer or the like may be used.

Nine diode sensors S1 to S9 are formed on the printing element board 10*b* as temperature sensors for detecting the temperature of ink near printing elements.

Among the nine diode sensors S1 to S9, the two diode sensors S1 and S6 are arranged near one end portion in the Y direction of the ejection port arrays 15 to 18. In more detail, the diode sensors S1 and S6 are arranged at positions 0.2 mm away from ejection ports on the one end portion in the Y direction. The diode sensor S1 is arranged at the midway between the ejection port array 15 and the ejection port array 16 in the X direction, and the diode sensor S6 is arranged at the midway between the ejection port array 17 and the ejection port array 18 in the X direction.

Furthermore, the two diode sensors S2 and S7 are arranged near the other end portion in the Y direction of the ejection port arrays 15 to 18. The diode sensor S2 is arranged at the midway between the ejection port array 15 and the ejection port array 16 in the X direction, and the diode sensor S7 is arranged at the midway between the ejection port array 17 and the ejection port array 18 in the X direction. In more detail, the diode sensors S2 and S7 are arranged at positions 0.2 mm away from ejection ports on the other end portion in the Y direction.

Furthermore, the five diode sensors S3, S4, S5, S8, and S9 are arranged at the center in the Y direction of the ejection port arrays 15 to 18. The diode sensor S4 is arranged at the midway between the ejection port array 15 and the ejection port array 16 in the X direction, the diode sensor S5 is arranged at the midway between the ejection port array 16 and the ejection port array 17 in the X direction, and the diode sensor S8 is arranged at the midway between the ejection port array 17 and the ejection port array 18 in the X direction. Furthermore, the diode sensor S3 is arranged outward in the X direction relative to the ejection port array 15, and the diode sensor S9 is arranged outward in the X direction relative to the ejection port array 18.

In this embodiment, the temperature of ink within an ejection port near a diode sensor is substantially the same as the temperature at the position of the printing element board 10*b* where the diode sensor is provided, and therefore the temperature of the printing element board 10*b* is regarded as the temperature of the ink.

Furthermore, heating elements (hereinafter, may also be referred to as sub-heaters) 19*a* and 19*b* for increasing the temperature of ink within ejection ports are provided at the printing element board 10*b*. The heating element 19*a* is formed of a continuous member so as to surround a side on which the diode sensor S3 is provided in the X direction of the ejection port array 15. Similarly, the heating element 19*b* is formed of a continuous member so as to surround a side on which the diode sensor S9 is provided in the X direction of the ejection port array 18. The heating elements 19*a* and 19*b* are positioned 1.2 mm outward from the ejection port array 13 in the X direction and 0.2 mm outward from the diode sensors S1, S2, S6, and S7 in the Y direction.

The printing element board 10*b* includes a substrate 31 on which various circuits are formed and an ejection port member 35 formed of a resin, as well as the diode sensors S1 to S9 and the sub-heaters 19*a* and 19*b*. A common ink chamber 33 is formed between the substrate 31 and the ejection port member 35, and an ink supply port 32 communicates with the common ink chamber 33. An ink flow passage 36 extends from the common ink chamber 33, and the ink flow passage 36 communicates with the ejection port 30 formed at the ejection port member 35. A bubbling chamber 38 is formed at an end portion on the ejection port 30 side in the ink flow passage 36, and a printing element (main heater) 34 is arranged at a position that faces the ejection port 30 in the bubbling chamber 38. Furthermore, a nozzle filter 37 is formed between the ink flow passage 36 and the common ink chamber 33.

The printing element board 10*b* has been described above in detail. The printing element board 10*a* also has a similar configuration.

Figure 4:
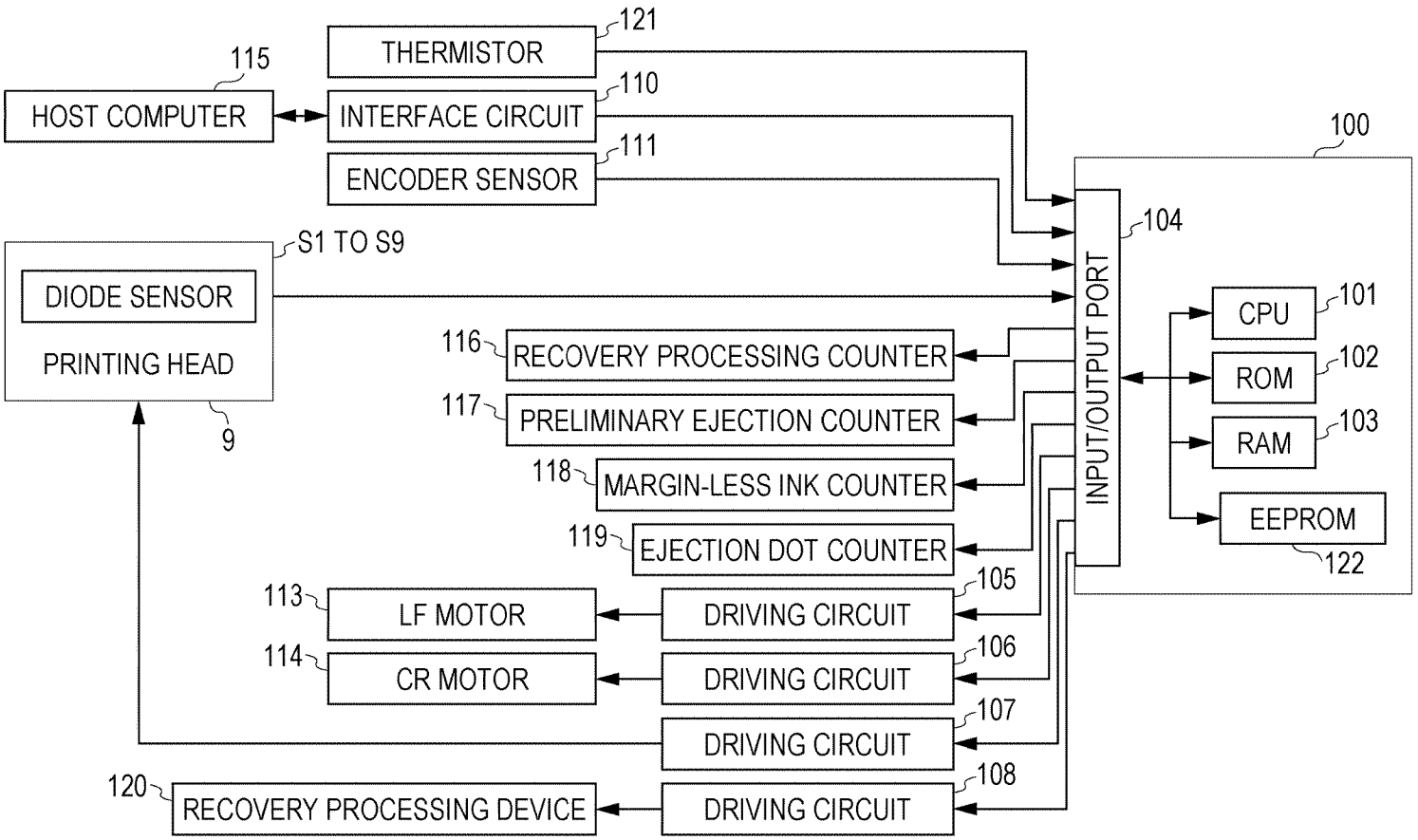
FIG. 4 is a schematic diagram illustrating a printing control system according to an embodiment.

FIG. 4 is a block diagram illustrating a configuration of a control system which is mounted on the ink jet printing apparatus according to this embodiment. A main controller 100 includes a CPU 101 which performs processing operations including arithmetic operation, control, determination, and setting. The main controller 100 also includes a read only memory (ROM) 102 which stores a control program and the like to be executed by the CPU 101, a random access memory (RAM) 103 to be used as a buffer storing binary printing data which indicates ejection/non-ejection of ink, a work area for processing by the CPU 101, and the like, an input/output port 104, and the like. The RAM 103 may also be used as a memory unit which stores the amount of ink in the main tank, the free space of a sub-tank, and the like before and after a printing operation. Driving circuits 105, 106, 107, and 108 for a conveyance motor (LF motor) 113 for driving a conveyance roller, a carriage motor (CR motor) 114, the printing head 9, and a recovery processing device 120, respectively, are connected to the input/output port 104. Each of the driving circuits 105, 106, 107, and 108 is controlled by the main controller 100. Various sensors including the diode sensors S1 to S9 for detecting the temperature of the printing head 9, an encoder sensor 111 fixed at the carriage unit 2, and a thermistor 121 for detecting the ambient temperature (environment temperature) inside the printing apparatus are connected to the input/output port 104. Furthermore, the main controller 100 is connected to a host computer 115 via an interface circuit 110.

Printing data to be printed as well as driving pulses to be applied, is transmitted from the driving circuit 107 which functions as a signal transmission unit to the printing head. The above data is transferred via the flexible printed circuit board 19 described above.

A recovery processing counter 116 counts the amount of ink in the case where ink is forcibly discharged from the printing head 9 by the recovery processing device 120. A preliminary ejection counter 117 counts preliminary ejection, which does not contribute to printing of an image performed before printing starts, after printing ends, or during printing. A margin-less ink counter 118 counts ink ejected outside a printing medium region in the case where margin-less printing is performed, and an ejection dot counter 119 counts ink ejected during printing.

Information regarding the accumulation of the amount of ink ejected by the printing head 9 counted by the counters 116 to 119 since mounting of the printing head 9 at the ink jet printing apparatus is stored in an electrically erasable programmable read-only memory (EEPROM) 122. Furthermore, various other types of information as well as the accumulation of the amount of ink ejection may be stored in the EEPROM 122.

Figure 5:
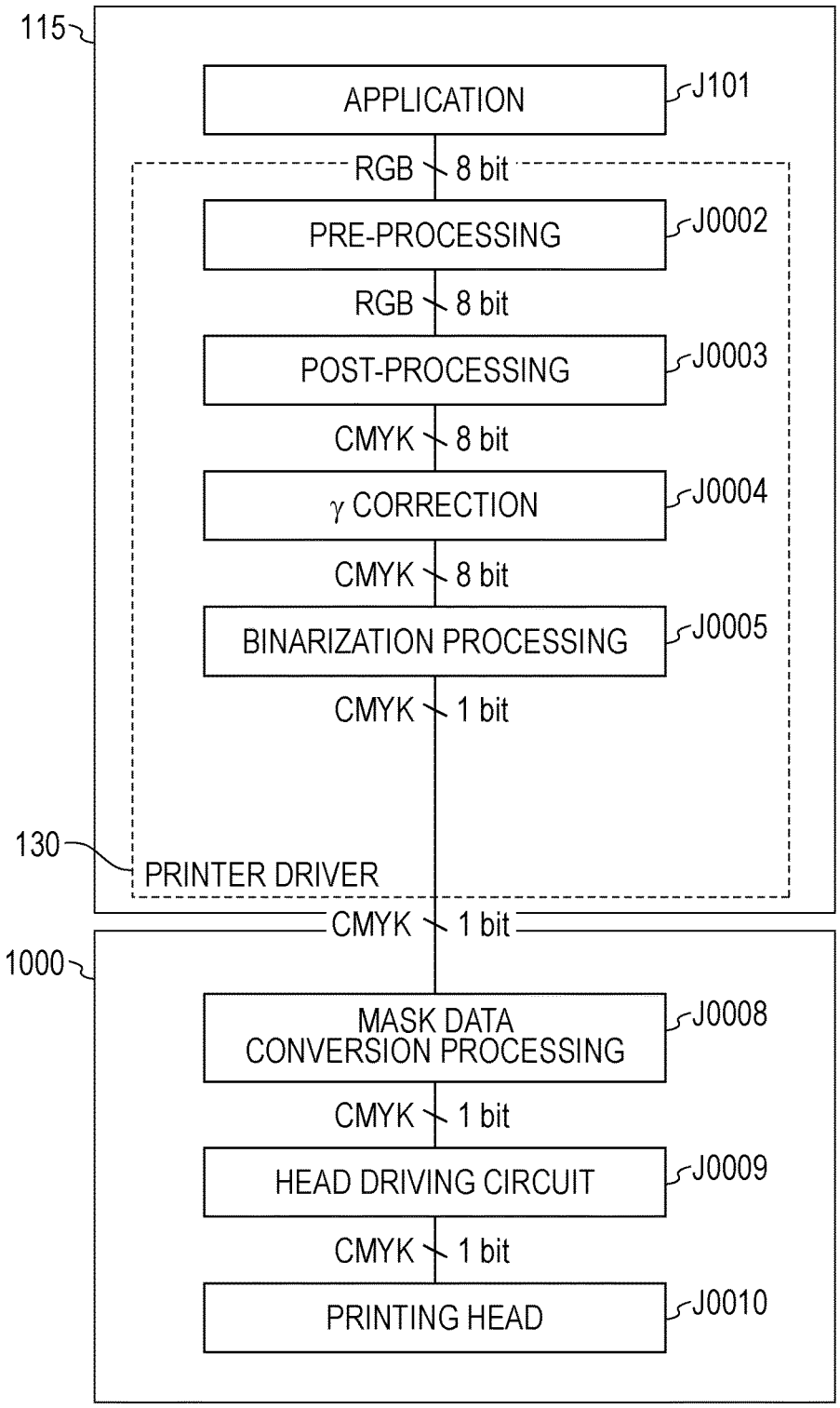
FIG. 5 is a diagram illustrating a processing process for data in an embodiment.

FIG. 5 is a flowchart for explaining a processing process for image data according to this embodiment.

Image data to be printed at an ink jet printing apparatus 1000 is created via an application J101 of the host computer 115. For printing, the image data created via the application J101 is transmitted to a printer driver 130. The printer driver 130 performs pre-processing J0002, post-processing J0003, γ correction J0004, and binarization processing J0005 for the created image data.

In the pre-processing J0002, color gamut conversion for converting the color gamut of a display device of the host computer 115 into the color gamut of a printer 1000 is performed. With the use of a three-dimensional lookup table, image data R, G, and B, each of which is represented by 8 bits, is converted into 8-bit data R, G, and B within the color gamut of the printer. In the post-processing J0003, color reproducing the converted color gamut is separated into color gamut of ink. Processing for obtaining 8-bit data which corresponds to an ink combination for reproducing the color represented by the 8-bit data R, G, and B within the print color gamut obtained in the pre-processing J0002 is performed. In the γ correction J0004, γ correction is performed for each 8-bit data obtained by color separation. Each 8-bit data obtained in the post-processing J0003 is converted so as to be linearly associated with the gradation characteristics of the ink jet printing apparatus. In the binarization processing J0005, quantization processing for generating binary data by converting each 8-bit data obtained in the γ correction J0004 into 1-bit data is performed. A density pattern method, a dithering method, an error diffusion, or the like may be used for the quantization processing.

The data generated as described above is supplied to the ink jet printing apparatus 1000. In mask data conversion processing J0008, conversion into printing data which indicates ejection/non-ejection of ink is performed based on the binary data created in the binarization processing J0005 and mask pattern data, which will be described later, stored in the ROM 102. The mask pattern is formed by arranging print permitted pixels for which ink ejection is permitted and print non-permitted pixels for which ink ejection is not permitted in a specific pattern. The mask pattern used for the mask data conversion processing J0008 is stored in advance in a predetermined memory in the ink jet printing apparatus. For example, by storing a mask pattern in the ROM 102 described above, conversion into printing data may be performed at the CPU 301 by using the mask pattern. Furthermore, different mask patterns may be used in an appropriate manner for the printing modes described later.

The printing data obtained by the mask data conversion processing is supplied to the head driving circuit 107 and the printing head 9. Based on the printing data, ink is ejected from individual ejection ports arranged at the printing head 9 to the printing medium P.

Based on the printing data created by the processing described above, driving of individual motors and the printing head is controlled, and a printing operation is thus performed.

The ink jet printing apparatus according to this embodiment is able to execute three types of printing modes: a four-pass printing mode in which printing is performed by causing a printing head to perform scanning four times for a unit region on a printing medium, a six-pass printing mode in which printing is performed by causing a printing head to perform scanning six times for a unit region, and a one-pass printing mode in which printing is performed by causing a printing head to perform scanning only once for a unit region.

In general, the larger the number of scanning times for a unit region, the higher the image quality of an image printed. Meanwhile, the larger the number of scanning times for a unit region, the longer the time required for completing printing. Thus, the ink jet printing apparatus according to this embodiment is set such that one of a "normal printing mode", a "high quality printing mode", and a "high-speed printing mode" is selected based on an instruction from a user and printing is performed under a desired printing condition. The "normal printing mode" corresponds to the four-pass printing mode, the "high-quality printing mode" corresponds to the six-pass printing mode, and a "high-speed printing mode" corresponds to the one-pass printing mode in this embodiment.

The four-pass printing mode, the six-pass printing mode, and the one-pass printing mode in this embodiment will be described below.

(Four-Pass Printing Mode)

In the four-pass printing mode in this embodiment, printing is performed by ejecting color ink in four scanning operations and then ejecting clear ink in two scanning operations.

Figure 6A:
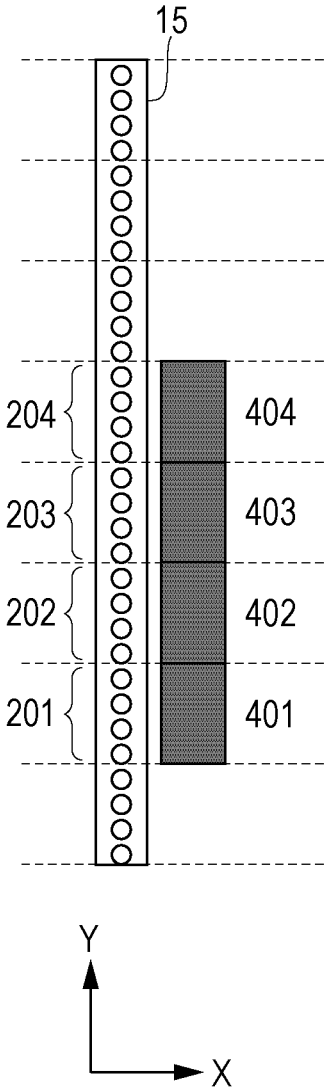
FIGS. 6A and 6B are schematic diagrams illustrating a printing mode in an embodiment.
Figure 6B:
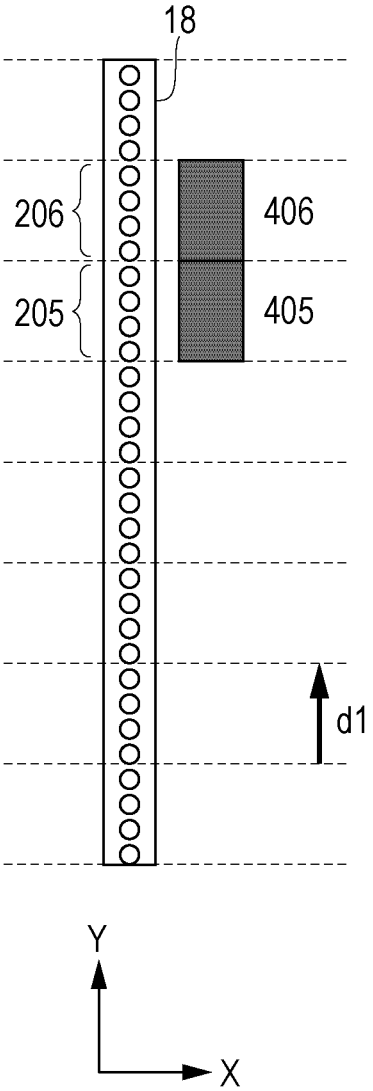

FIGS. 6A and 6B are diagrams for explaining the four-pass printing mode in this embodiment. For the sake of simplification, only the ejection port array 15 for ejecting cyan ink and the ejection port array 18 for ejecting clear ink are illustrated. For ejection port arrays for ejecting color ink other than cyan ink, control similar to that for the ejection port array 15 for ejecting cyan ink is performed. Furthermore, for the sake of simplification, the case where the ejection port arrays each include 32 ejection ports is illustrated.

FIG. 6A is a diagram schematically illustrating ejection port groups in the ejection port array 15 used in the four-pass printing mode and mask patterns used for the ejection port groups. FIG. 6B is a diagram schematically illustrating ejection port groups in the ejection port array 18 used in the four-pass printing mode and mask patterns used for the ejection port groups.

As is clear from FIG. 6A, in the four-pass printing mode, the ejection port array 15 for ejecting cyan ink is divided into eight ejection port groups each including four ejection ports, and four ejection port groups 201 to 204 among the eight ejection port groups are used for printing for a unit region. The ejection ports other than the ejection port groups 201 to 204 arranged in the ejection port array 15 are not used for printing in the four-pass printing mode.

In more detail, in the first scanning operation of four scanning operations for ejecting cyan ink to a unit region, ink is ejected to the unit region on a printing medium from the ejection port group 201 in accordance with printing data generated using a mask pattern 401. After that, the printing medium is conveyed by a distance d1 which corresponds to the length of a single ejection port group in the Y direction. Accordingly, the unit region for which printing has been performed from the ejection port group 201 by the first scanning operation is located at the position that faces the ejection port group 202. In this state, the second scanning operation for the unit region is performed, and ink is ejected to the unit region from the ejection port group 202 in accordance with printing data generated using a mask pattern 402.

Similarly, in the third and fourth scanning operations for the unit region, with conveyance by the distance d1, ink is ejected from the ejection port groups 203 and 204 in accordance with printing data generated using mask patterns 403 and 404.

In the mask patterns 401 to 404 which are schematically illustrated in FIG. 6A, a darker color indicates a higher print permission ratio, which is a ratio of the number of print permitted pixels to the number of pixels in each region in a mask pattern, and a lighter color indicates a lower print permission ratio. In the mask patterns illustrated in FIG. 6A, the color density is constant among the regions. Therefore, the print permission ratio is substantially constant among the regions.

FIGS. 7A to 7D are diagrams illustrating the mask patterns 401 to 404, respectively. In FIGS. 7A to 7D, black portions represent print permitted pixels, and white portions represent print non-permitted pixels. Furthermore, mask patterns each having a size corresponding to 16 pixels in the X direction and 4 pixels in the Y direction, that is, 64 pixels in total, are illustrated. However, the mask patterns may have different sizes in an appropriated manner.

As is clear from FIGS. 7A to 7D, the mask patterns 401 to 404 are arranged such that print permitted pixels are mutually exclusive and complementary to each other. That is, patterns may be obtained such that print permitted pixels are arranged in all the pixels when the logical sum of print permitted pixels in the mask patterns 401 to 404 is obtained.

Furthermore, the mask patterns 401 to 404 are set to have substantially the same print permission ratio. For example, in the mask pattern 401 which corresponds to the first scanning operation illustrated in FIG. 7A, 16 of 64 pixels are print permitted pixels. Therefore, the print permission ratio of the mask pattern 401 is 25% (=16/64*100%). Similarly, the print permission ratio of each of the mask patterns 402 to 404 is 25%.

Figure 7A:
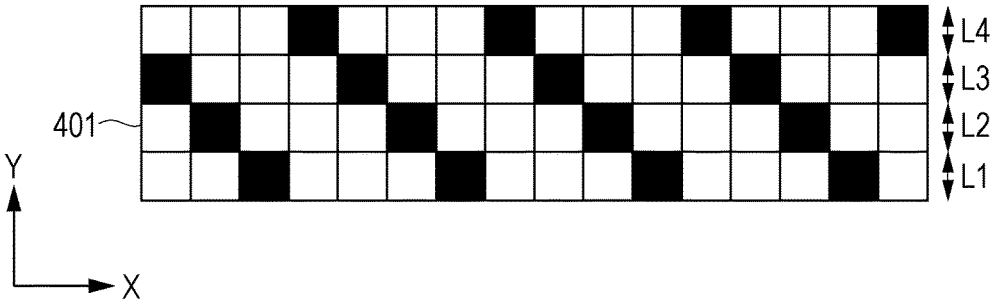
FIGS. 7A to 7D are diagrams illustrating mask patterns used in an embodiment.
Figure 7B:
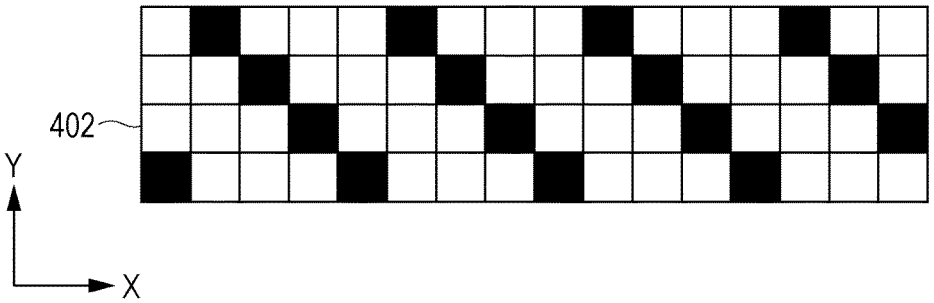
Figure 7C:
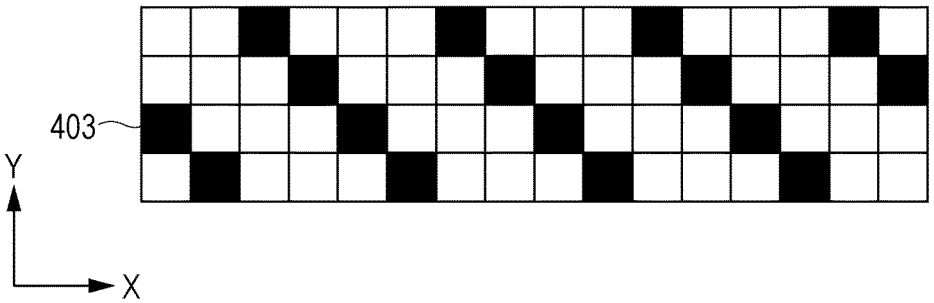
Figure 7D:
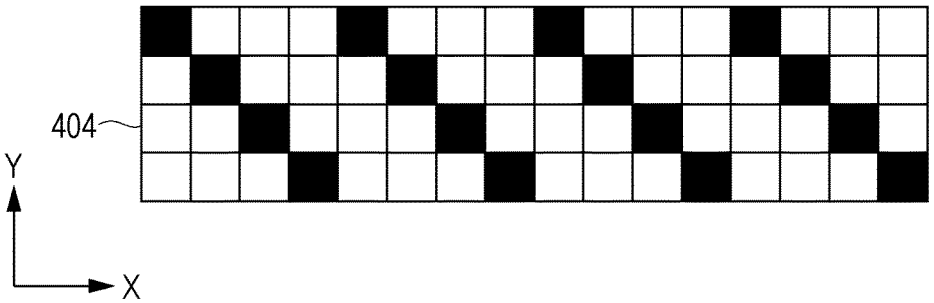

Furthermore, the mask patterns 401 to 404 are set to have substantially the same print permission ratio, regardless of the position in the Y direction within the mask patterns. For example, the print permission ratio of a pixel row L1 at the most upstream side in the Y direction of the mask pattern corresponding to the first scanning operation illustrated in FIG. 7A is 25% (=4/16*100%). Furthermore, the print permission ratio of a pixel row L2 at the second most upstream side in the Y direction is 25% (=4/16*100%). Furthermore, the print permission ratio of a pixel row L3 at the second most downstream side in the Y direction is 25% (=4/16*100%). Furthermore, the print permission ratio of a pixel row L4 at the most downstream side in the Y direction is 25% (=4/16*100%). Accordingly, a constant print permission ratio is set in the mask pattern 401, regardless of the position in the Y direction. The same applies to the other mask patterns 402 to 404.

Meanwhile, as is clear from FIG. 6B, in the four-pass printing mode, as with the ejection port array 15 for ejecting cyan ink, the ejection port array 18 for ejecting clear ink is also divided into eight (predetermined number) ejection port groups each having four ejection ports, and two ejection port groups 205 and 206 of the eight ejection port groups are used for printing for a unit region. The ejection ports other than the ejection port groups 205 and 206 arranged in the ejection port array 18 are not used for printing in the four-pass printing mode.

The ejection port groups 205 and 206 are positioned on a downstream side in the Y direction relative to the ejection port groups 201 to 204. Therefore, after cyan ink is provided to a unit region on a printing medium, clear ink may be provided. In more detail, after ejection from the ejection port group 204 in the fourth scanning operation of four scanning operations for a unit region for ejecting cyan ink is performed, the printing medium is conveyed by the distance d1 which corresponds to the length of a single ejection port group in the Y direction. Accordingly, the unit region for which printing has been performed from the ejection port group 204 by the fourth scanning operation is located at a position that faces the ejection port group 205. In this state, the first scanning operation of two scanning operations for ejecting clear ink is performed, and ink is ejected to the unit region from the ejection port group 205 in accordance with printing data generated using a mask pattern 405. After that, the printing medium is conveyed by the distance d1 in a similar manner. Then, the second scanning operation for ejecting clear ink to the unit region is performed, and ink is ejected from the ejection port group 206 in accordance with printing data generated using a mask pattern 406.

In the mask patterns 405 and 406 which are schematically illustrated in FIG. 6B, a darker color indicates a higher print permission ratio, which is a ratio of the number of print permitted pixels to the number of pixels in each region in a mask pattern, and a lighter color indicates a lower print permission ratio. In the mask patterns illustrated in FIG. 6B, the color density is constant among the regions. Therefore, the print permission ratio is substantially constant among the regions. In more detail, the mask patterns 405 and 406 are arranged such that print permitted pixels are mutually exclusive and complementary to each other. Furthermore, the mask patterns 405 and 406 are set to have substantially the same print permission ratio, that is, about 50%. Explanation for the detailed arrangement of the print permitted pixels in the mask patterns 405 and 406 will be omitted.

As described above, in the four-pass printing mode in this embodiment, an image is printed by ejecting color ink in four scanning operations and then ejecting clear ink in two scanning operations.

(Six-Pass Printing Mode)

In the six-pass printing mode in this embodiment, printing is performed by ejecting color ink in six scanning operations and then ejecting clear ink in two scanning operations.

Figure 8A:
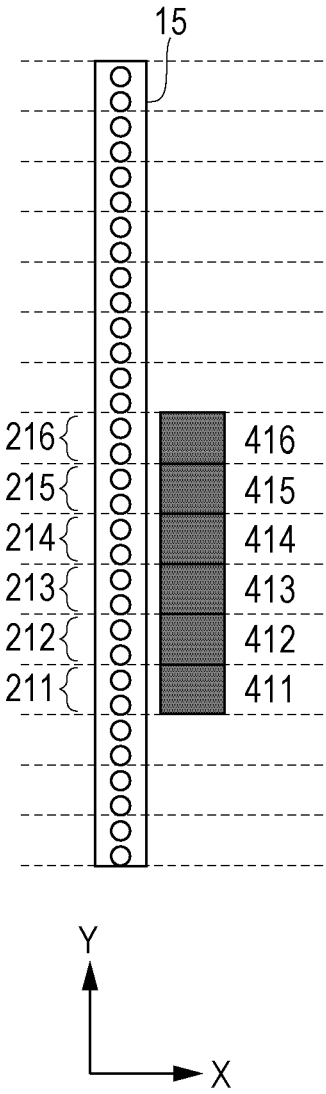
FIGS. 8A and 8B are schematic diagrams illustrating a printing mode in an embodiment.
Figure 8B:
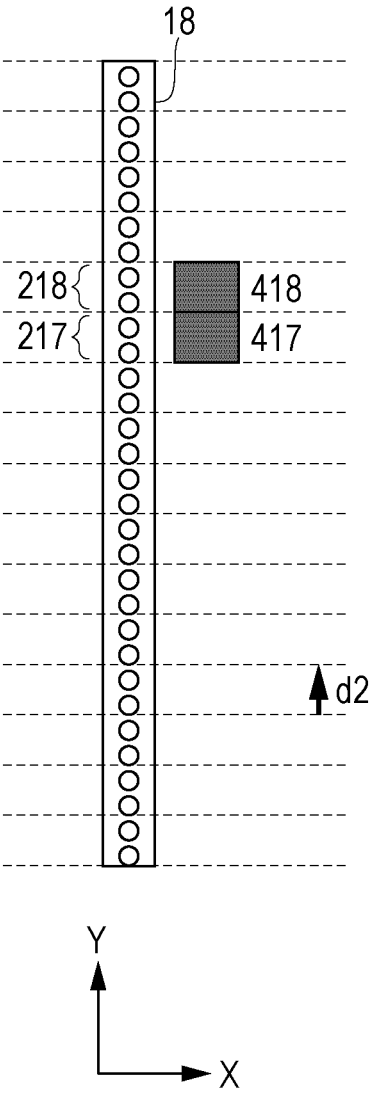

FIGS. 8A and 8B are diagrams for explaining the six-pass printing mode in this embodiment. For the sake of simplification, explanation for parts similar to those of the four-pass printing mode illustrated in FIGS. 6A and 6B will be omitted.

FIG. 8A is a diagram schematically illustrating ejection port groups in the ejection port array 15 used in the six-pass printing mode and mask patterns used for the ejection port groups. FIG. 8B is a diagram schematically illustrating ejection port groups in the ejection port array 18 used in the six-pass printing mode and mask patterns used for the ejection port groups.

As is clear from FIG. 8A, in the six-pass printing mode, the ejection port array 15 for ejecting cyan ink is divided into sixteen ejection port groups each including two ejection ports, and six ejection port groups 211 to 216 among the sixteen ejection port groups are used for printing for a unit region. The ejection ports other than the ejection port groups 211 to 216 arranged in the ejection port array 15 are not used for printing in the six-pass printing mode.

In more detail, in the first scanning operation of six scanning operations for ejecting cyan ink to a unit region, ink is ejected to the unit region on a printing medium from the ejection port group 211 in accordance with printing data generated using a mask pattern 411. After that, the printing medium is conveyed by a distance d2 which corresponds to the length of a single ejection port group in the Y direction. The number of ejection ports constituting a single ejection port group is smaller than that for the four-pass printing mode, and therefore the distance d2 is shorter than the distance d1. By the above conveyance, the unit region for which printing has been performed from the ejection port group 211 by the first scanning operation is located at the position that faces the ejection port group 212. In this state, the second scanning operation for the unit region is performed, and ink is ejected to the unit region from the ejection port group 212 in accordance with printing data generated using a mask pattern 412.

Similarly, with conveyance by the distance d2, ink is ejected from the ejection port groups 213 to 216 in accordance with printing data generated using mask patterns 413 to 416 by the third to sixth scanning operations for the unit region.

In the mask patterns 411 to 416 which are schematically illustrated in FIG. 8A, a darker color indicates a higher print permission ratio, which is a ratio of the number of print permitted pixels to the number of pixels in each region in a mask pattern, and a lighter color indicates a lower print permission ratio. In the mask patterns 411 to 416 illustrated in FIG. 8A, the color density is constant among the regions. Therefore, the print permission ratio is substantially constant among the regions. In more detail, the mask patterns 411 to 416 are arranged such that print permitted pixels are mutually exclusive and complementary to each other. Furthermore, the mask patterns 411 to 416 are set to have substantially the same print permission ratio, that is, about 16.7%. Explanation for the detailed arrangement of the print permitted pixels in the mask patterns 411 to 416 will be omitted.

Meanwhile, as is clear from FIG. 8B, in the six-pass printing mode, the ejection port array 18 for ejecting clear ink is divided into sixteen ejection port groups each including two ejection ports, and two ejection port groups 217 and 218 among the sixteen ejection port groups are used for printing for a unit region. The other ejection ports other than the ejection port groups 217 and 218 arranged in the ejection port array 18 are not used for printing in the six-pass printing mode.

The ejection port groups 217 and 218 are positioned on a downstream side in the Y direction relative to the ejection port groups 211 to 216. Therefore, after cyan ink is provided to a unit region on a printing medium, clear ink may be provided. In more detail, after ejection from the ejection port group 216 in the sixth scanning operation of six scanning operations for a unit region for ejecting cyan ink is performed, the printing medium is conveyed by the distance d2 which corresponds to the length of a single ejection port group in the Y direction. Accordingly, the unit region for which printing has been performed from the ejection port group 216 by the sixth scanning operation is located at the position that faces the ejection port group 217. In this state, the first scanning operation of two scanning operations for ejecting clear ink is performed, and ink is ejected to the unit region from the ejection port group 217 in accordance with printing data generated using a mask pattern 417. After that, the printing medium is conveyed by the distance d2 in a similar manner. Then, the second scanning operation for ejecting clear ink to the unit region is performed, and ink is ejected from the ejection port group 218 in accordance with printing data generated using a mask pattern 418.

In the mask patterns 417 and 418 which are schematically illustrated in FIG. 8B, a darker color indicates a higher print permission ratio, which is a ratio of the number of print permitted pixels to the number of pixels in each region in a mask pattern, and a lighter color indicates a lower print permission ratio. In the mask patterns illustrated in FIG. 8B, the color density is constant among the regions. Therefore, the print permission ratio is substantially constant among the regions. In more detail, the mask patterns 417 and 418 are arranged such that print permitted pixels are mutually exclusive and complementary to each other. Furthermore, the mask patterns 417 and 418 are set to have substantially the same print permission ratio, that is, about 50%. Explanation for the detailed arrangement of the print permitted pixels in the mask patterns 417 and 418 will be omitted.

As described above, in the six-pass printing mode in this embodiment, an image is printed by ejecting color ink in six scanning operations and then ejecting clear ink in two scanning operations.

(One-Pass Printing Mode)

In the one-pass printing mode in this embodiment, printing is performed by only ejecting color ink in one scanning operation without ejecting clear ink.

Figure 9:
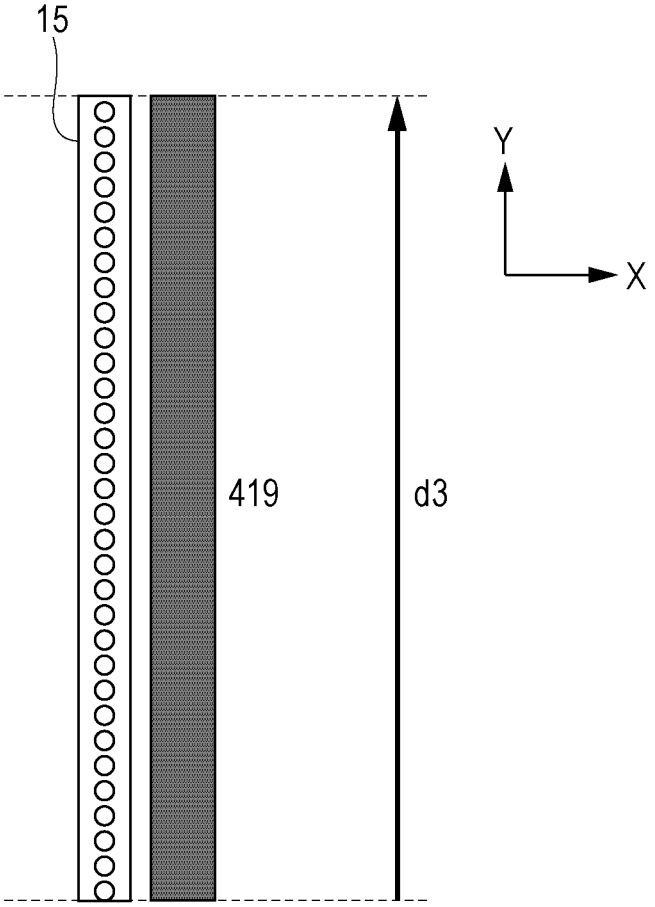
FIG. 9 is a schematic diagram illustrating a printing mode in an embodiment.

FIG. 9 is a diagram for explaining the one-pass printing mode in this embodiment. For the sake of simplification, explanation for parts similar to those in the four-pass printing mode illustrated in FIGS. 6A and 6B and in the six-pass printing mode illustrated in FIGS. 8A and 8B will be omitted.

As is clear from FIG. 9, in the one-pass printing mode, unlike the four-pass printing mode and the six-pass printing mode, printing is performed by using all the ejection port arrays without dividing the ejection port array 15 for ejecting cyan ink into a plurality of ejection port groups.

In more detail, printing is performed for a unit region from all the ejection ports within the ejection port array 15 in accordance with printing data generated using a mask pattern 419 in one scanning operation. By the one scanning operation, printing for the unit region is completed.

After that, the printing medium is conveyed by a distance d3 (>d1) which corresponds to the length of a single ejection port array 15 in the Y direction. Accordingly, the next unit region for which printing is to be performed is located at the position that faces the ejection port array 15. In this state, the first scanning operation for the next unit region for which printing is to be performed is performed.

In the mask pattern 419 which is schematically illustrated in FIG. 9, a darker color indicates a higher print permission ratio, which is a ratio of the number of print permitted pixels to the number of pixels in each region in a mask pattern, and a lighter color indicates a lower print permission ratio. In the mask pattern 419 illustrated in FIG. 9, the color density is constant among the regions. Therefore, the print permission ratio is substantially constant among the regions. In more detail, the mask pattern 419 is arranged such that print permitted pixels are arranged at all the positions and the print permission ratio is 100%.

As describe above, in the one-pass printing mode in this embodiment, an image is printed by ejecting color ink in one scanning operation without ejecting clear ink.

(Variations in Ejection Characteristics Caused by Ink Kogation)

Ink kogation which may occur when a printing element is driven in this embodiment will be described in detail below.

As described above, color ink used in this embodiment contains pigment as color materials. Such ink containing pigment exists in a state in which the pigment is diffused in ink solvent. Therefore, kogation is likely to occur when ink is ejected by thermal energy, compared to ink containing dye as color materials. In particular, as is clear from an experiment, kogation easily occurs especially with ink having a high polarity among ink containing pigment. It may be assumed that the high probability of occurrence of kogation is caused by the fact that ink having a high polarity has a high melting point and a high boiling point.

Among seven types of color ink used in this embodiment, cyan ink has a higher polarity than the other six types of ink. Therefore, kogation of ink may remarkably occur especially when a printing element is driven for cyan ink.

In the case where kogation is deposited on the surface of a printing element, the ejection characteristics such as the ejection speed and the ejection amount may vary. For example, as the number of driving times of the printing element since mounting of the printing head on the ink jet printing apparatus increases, the deposited amount of ink kogation on the surface of a printing element increases, and the ejection speed therefore decreases. The variations in the ejection characteristics may cause various types of image deterioration such as a decrease in the landing accuracy of ink and vagueness of the outline of an image.

Figure 10:
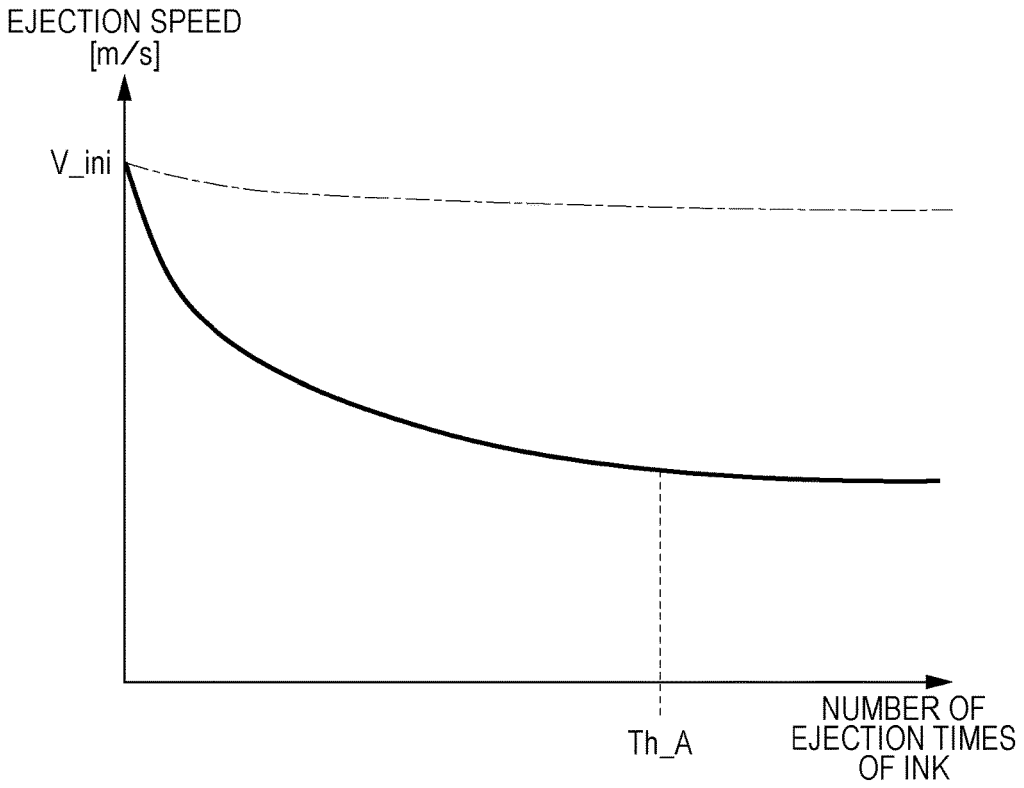
FIG. 10 is a graph for explaining the correlation between the number of ejection times and the ejection speed of ink.

FIG. 10 is a graph illustrating the correlation between the number of ejection times of ink, which corresponds to the number of driving times of a printing element, and the ejection speed of ink. In FIG. 10, a solid line represents the correlation between the number of ejection times and the ejection speed of cyan ink used in in this embodiment. A broken line represents the correlation between the number of ejection times and the ejection speed of black ink used in this embodiment. Regarding the horizontal axis, the number of ejection times increases from left to right. Regarding the vertical axis, the ejection speed increases from bottom to top.

As is clear from FIG. 10, for black ink whose polarity is not very high, even if the number of ejection times of ink (the number of driving times of a printing element) increases, the amount of kogation is not large, and therefore the variation in the ejection speed is small. In contrast, for cyan ink with a high polarity, kogation accumulated on the surface of the printing element increases as the number of ejection times of ink (the number of driving times of the printing element) increases, and therefore the ejection speed remarkably decreases.

In the case where printing is performed in the above-described four-pass printing mode or six-pass printing mode, printing is performed using only some ejection ports of the ejection port array 15 for ejecting cyan ink, as described above with reference to FIGS. 6A to 8B. Therefore, kogation is deposited on only some printing elements that are used for printing.

For example, in the case where printing is performed for a printing medium in the four-pass printing mode, a state may occur in which kogation is deposited on the surface of printing elements (forming printing element groups in the printing element array) that face the ejection port groups 201 to 204 in the ejection port array 15 illustrated in FIGS. 6A and 6B and kogation does not occur on the surface of the other printing elements. As a result, the ejection speed of ink from the ejection port groups 201 to 204 is lower than the ejection speed of ink from the other ejection ports.

After printing for the printing medium is performed, if the above-described one-pass printing mode is selected for printing for the next printing medium, ink is ejected from all the ejection ports. In this case, due to a reduction in the ejection speed caused by ink kogation only at the ejection port groups 201 to 204 within the ejection port array 15, unevenness of the density occurs between regions to which ink is ejected from the ejection port groups 201 to 204 and regions to which ink is ejected from the other ejection ports.

Furthermore, in the case where printing is performed for a certain printing medium in the six-pass printing mode, kogation is deposited on the surfaces of only printing elements that face the ejection port groups 211 to 216 within the ejection port array 15 illustrated in FIGS. 8A and 8B, and therefore the ejection speed of ink from the ejection port groups 211 to 216 is lower than the ejection speed of ink from the other ejection ports.

Accordingly, if printing is performed for the next printing medium in the one-pass printing mode, unevenness of the density may occur between regions to which ink is ejected from the ejection port groups 211 to 216 within the ejection port array 15 and regions to which ink is ejected from the other ejection ports. As is clear from FIGS. 6A to 8B, the ejection port groups 211 to 216 are different from the ejection port groups 201 to 204, and therefore the unevenness of the density which may occur when the one-pass printing mode is executed after execution of the six-pass printing mode is different from the unevenness of the density which may occur when the one-pass printing mode is executed after execution of the four-pass printing mode.

(Kogation Nonuniformity Reduction Control)

In view of the above, in this embodiment, after printing is performed for a single printing medium in accordance with a certain printing mode, control for reducing nonuniformity of ejection characteristics caused by kogation among printing elements is performed in a different manner depending on the printing mode. In more detail, by driving a printing element which has not been used in a printing mode executed for printing for the previous printing medium to perform preliminary ejection of ink, which does not contribute to printing of an image, control for generating kogation also on a printing element which has not been used for printing is performed.

Figure 11:
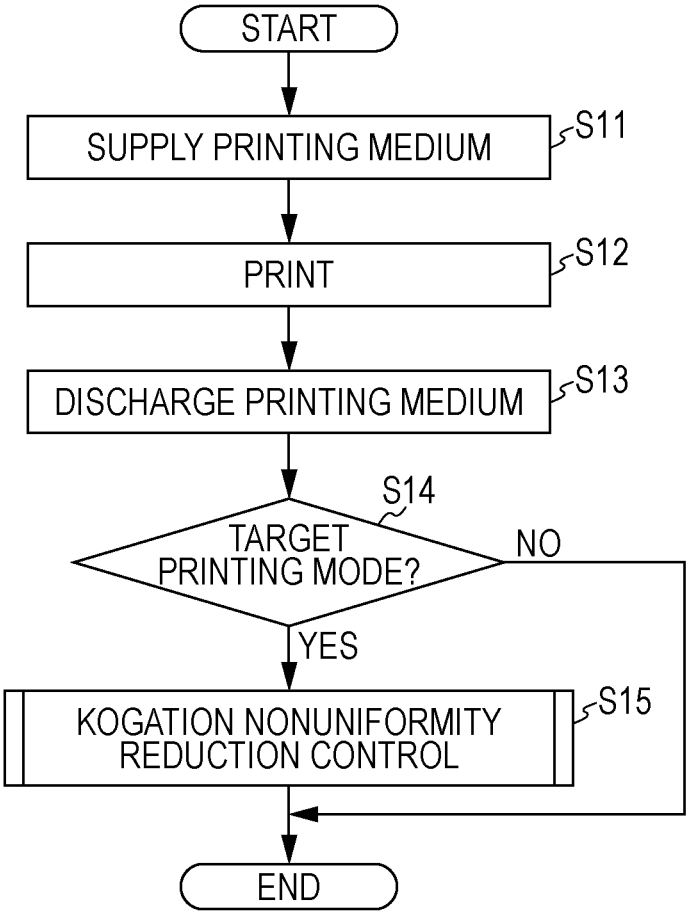
FIG. 11 is a diagram illustrating a process until execution of kogation nonuniformity reduction control in an embodiment.

FIG. 11 is a flowchart of control for determining whether or not to execute control for reducing nonuniformity of kogation, the control being performed by the CPU in accordance with a control program according to this embodiment.

When receiving printing data, the ink jet printing apparatus supplies a printing medium in step S11. Next, in step S12, printing on a single printing medium is performed in accordance with a selected printing mode. Then, in step S13, the printing medium on which printing is performed is discharged.

In step S14, it is determined whether or not the printing mode executed when printing is performed in step S12 is a printing mode which executes kogation nonuniformity reduction control among the four-pass printing mode, the six-pass printing mode, and the one-pass printing mode. As described above, in this embodiment, nonuniformity of kogation may occur in the four-pass printing mode and the six-pass printing mode. Thus, in this embodiment, in the case where printing is performed in the four-pass printing mode or the six-pass printing mode, the process proceeds to step S15, in which kogation nonuniformity reduction control is performed. In contrast, in the case where printing is performed in the one-pass printing mode, the amount of nonuniformity of kogation is not large, and therefore the kogation nonuniformity reduction control is not performed. In this embodiment, kogation nonuniformity reduction control is performed only for the ejection port array 15 for ejecting cyan ink, for which kogation may remarkably occur, among seven types of ink, and the kogation nonuniformity reduction control is not performed for ejection port arrays for ejecting the other types of ink.

Figure 12:
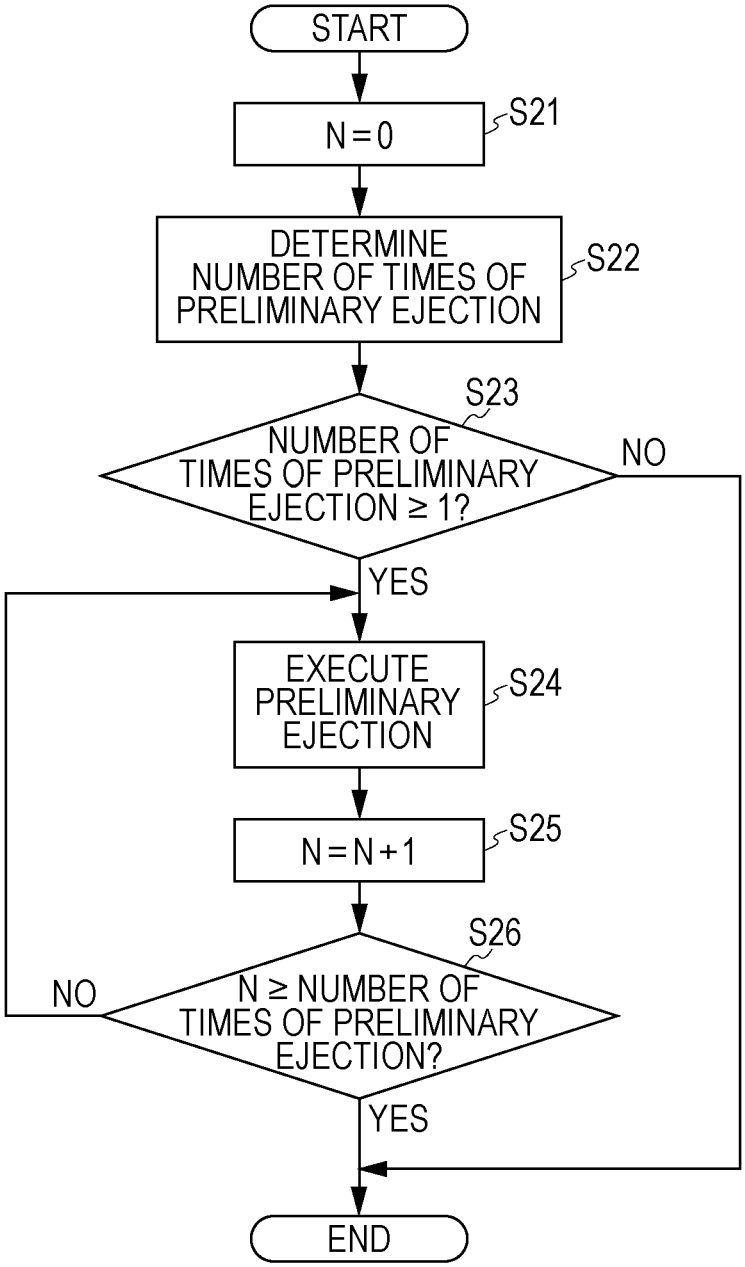
FIG. 12 is a diagram for explaining a processing process of kogation nonuniformity reduction control in an embodiment.

FIG. 12 is a flowchart of kogation nonuniformity reduction control which is executed by the CPU in accordance with a control program according to this embodiment.

When execution of the kogation nonuniformity reduction control is determined in step S15, a counter value N is set to 0 in step S21.

Next, in step S22, the number of times of preliminary ejection to be executed from an ejection port which has not been used for printing is determined. The number of times of preliminary ejection is calculated using equation 1.

$$\text{Number of times of preliminary ejection} = \text{dot count value} / \text{number of ejection ports used} * \text{weighting coefficient} \quad \text{(Equation 1)}$$

The dot count value represents the number of ejection times of ink acquired when printing is performed in step S12 and is a value which is stored in the ink jet printing apparatus at the time of printing in step S12.

Furthermore, the number of ejection ports used represents the number of ejection ports used when printing is performed in step S12, and different values are stored in advance for printing modes. For example, in the four-pass printing mode illustrated in FIGS. 6A and 6B, the ejection port groups 201 to 204 are used for printing, and therefore the number of ejection ports used is 16 (=4×4). Furthermore, in the six-pass printing mode illustrated in FIGS. 8A and 8B, the ejection port groups 211 to 216 are used for printing, and therefore the number of ejection ports used is 12 (=2×6).

By dividing the dot count value by the number of ejection ports used, the average value of the number of ejection times of ink per ejection port used may be calculated. By performing preliminary ejection of ink by the calculated average value from an ejection port which has not been used for printing, the number of times of preliminary ejection of ink from an ejection port which has not been used for printing may be made equal to the average value of the number of ejection times at the time of printing from ejection ports used for printing. Accordingly, the amount of kogation deposited on the surface of a printing element that faces an ejection port which has been used for printing may be made substantially equal to the amount of kogation deposited on the surface of a printing element that faces an ejection port which has not been used for printing.

In actuality, however, kogation does not need to be provided to a printing element that faces an ejection port which has not been used to an extent substantially equal to the amount of kogation deposited on a printing element that faces an ejection port which has been used for printing, and providing kogation to an extent in which unevenness of the density among ejection ports is not remarkable is sufficient. Thus, in this embodiment, the actual number of times of preliminary ejection is determined by multiplying the above-mentioned average value by a weighting coefficient. In this embodiment, as is clear from an experiment, with the amount of kogation which is substantially half the amount of kogation deposited on a printing element that faces an ejection port which has been used, unevenness of the density among ejection ports is difficult to visually recognize. Therefore, in this embodiment, a value of 0.5 is set as the weighting coefficient. Accordingly, unnecessary execution of preliminary ejection may be reduced, and a reduction in the consumption of ink in preliminary ejection may thus be achieved. Furthermore, a reduction in the time required for a preliminary ejecting operation may also be achieved.

Although in this case, a value of 0.5 is set as the weighting coefficient, a different value may be set as the weighting coefficient in an appropriate manner. Furthermore, if the amount of kogation is desired to be the same among ejection ports, the average value may be directly set as the number of times of preliminary ejection without multiplication of the weighting coefficient.

Next, in step S23, it is determined whether or not the number of times of preliminary ejection determined in step S22 is one or more. In the case where the number of times of preliminary ejection is less than one, the kogation nonuniformity reduction control ends. In the case where it is determined that the number of times of preliminary ejection is one or more, the process proceeds to step S24.

In step S24, preliminary ejection of ink, which does not contribute to printing of an image, is performed once for a predetermined preliminary ejection part which is provided within the ink jet printing apparatus, by using a preliminary ejection pattern which corresponds to the printing mode at the time of printing in step S12.

Figure 13A:
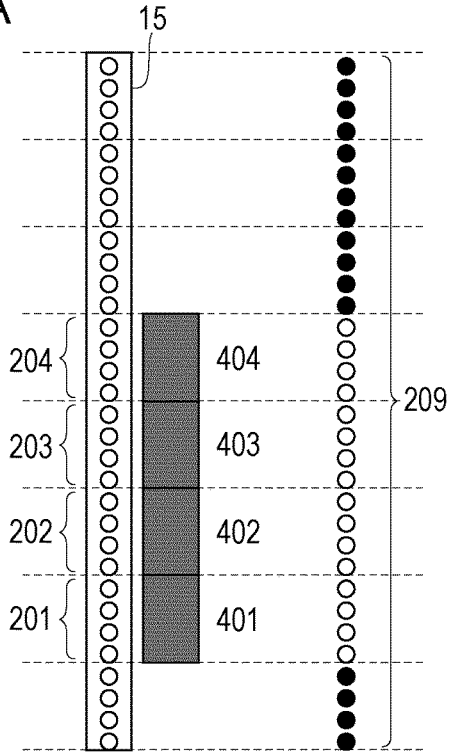
FIGS. 13A and 13B are diagrams for explaining preliminary ejection patterns in an embodiment.
Figure 13B:
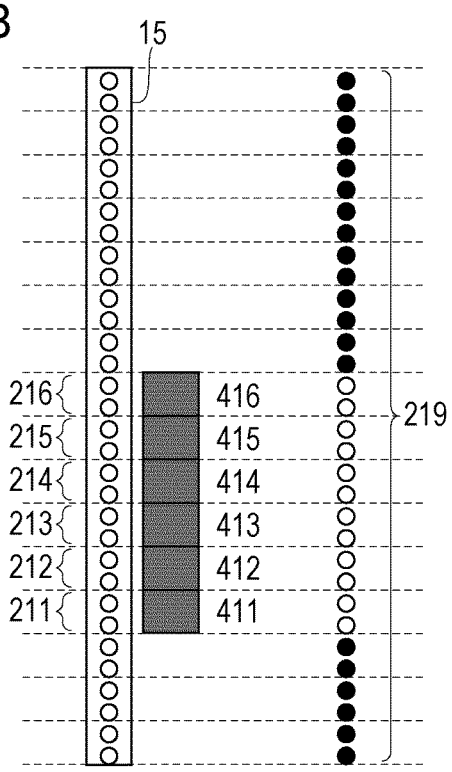

FIG. 13A is a diagram illustrating a preliminary ejection pattern 209 which is used in step S24 in the case where printing is performed in the four-pass printing mode. FIG. 13B is a diagram illustrating a preliminary ejection pattern 219 which is used in step S24 in the case where printing is performed in the six-pass printing mode. In the preliminary ejection patterns 209 and 219 illustrated in FIGS. 13A and 13B, black portions represent ejection ports from which preliminary ejection is performed, and white portions represent ejection ports from which preliminary ejection is not performed.

A preliminary ejection pattern in this embodiment is set such that ink is ejected from all the ejection ports that have not been used for printing. For example, the ejection port groups 201 to 204 of the ejection port array 15 for ejecting cyan ink are used for printing in the four-pass printing mode, and therefore the preliminary ejection pattern 209 is set such that ink is ejected from all the ejection ports other than the ejection port groups 201 to 204 within the ejection port array 15. Furthermore, the ejection port groups 211 to 216 of the ejection port array 15 for ejecting cyan ink are used for printing in the six-pass printing mode, and therefore the preliminary ejection pattern 219 is set such that ink is ejected from all the ejection ports other than the ejection port groups 211 to 216 within the ejection port array 15.

Although the case where preliminary ejection of ink is performed only once per ejection port in the preliminary ejecting operation in step S24 has been described above, preliminary ejection of ink may be performed a plurality of times per ejection port in a single preliminary ejecting operation.

Next, in step S25, the counter value N is incremented by one. Since the counter value N is set to 0 in step S21, the counter value N is increased to 1 in step S25.

Next, in step S26, it is determined whether or not the counter value N is equal to or greater than the number of times of preliminary ejection determined in step S22. In the case where it is determined that the counter value N is equal to or greater than the number of times of preliminary ejection, the number of times the preliminary ejecting operation has been performed in step S24 is equal to or greater than the number of times of preliminary ejection determined in step S22, and therefore the kogation nonuniformity reduction control ends. In contrast, in the case where it is determined that the counter value N is smaller than the number of times of preliminary ejection, the process returns to step S24, and the preliminary ejecting operation is performed again.

Then, the processing of steps S24 to S26 is repeatedly performed. Similar control is performed until it is determined in step S26 that the counter value N is equal to or greater than the number of times of preliminary ejection determined in step S22.

With this configuration, after printing is performed in any printing mode, the amount of deposited kogation may be substantially the same among printing elements when printing is performed for the next printing medium. Accordingly, for example, even in the case where printing is performed in the four-pass printing mode or the six-pass printing mode and then printing is performed in the one-pass printing mode, a degradation in the image quality caused by a difference in the ejection characteristics within an ejection port array may be suppressed.

Second Embodiment

In the first embodiment, a configuration is described in which mask patterns which are set such that the print permission ratio is substantially constant regardless of the position in the Y direction in each of the four-pass printing mode and the six-pass printing mode are used.

In a second embodiment, a configuration will be described in which mask patterns which are set such that the print permission ratio varies according to the position in the Y direction in each of the four-pass printing mode and the six-pass printing mode are used.

Explanation for parts similar to those in the first embodiment described above will be omitted.

In this embodiment, mask patterns which are different from the mask patterns used in the first embodiment are used in the four-pass printing mode and the six-pass printing mode.

(Four-Pass Printing Mode)

Figure 14A:
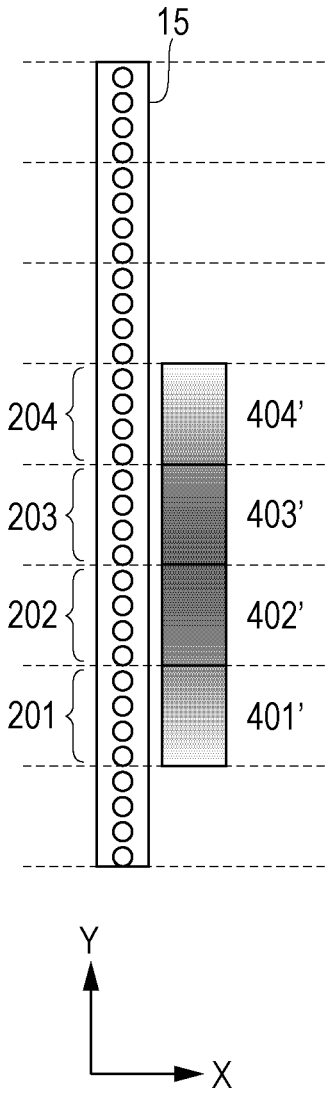
FIGS. 14A and 14B are schematic diagrams illustrating a printing mode in an embodiment.
Figure 14B:
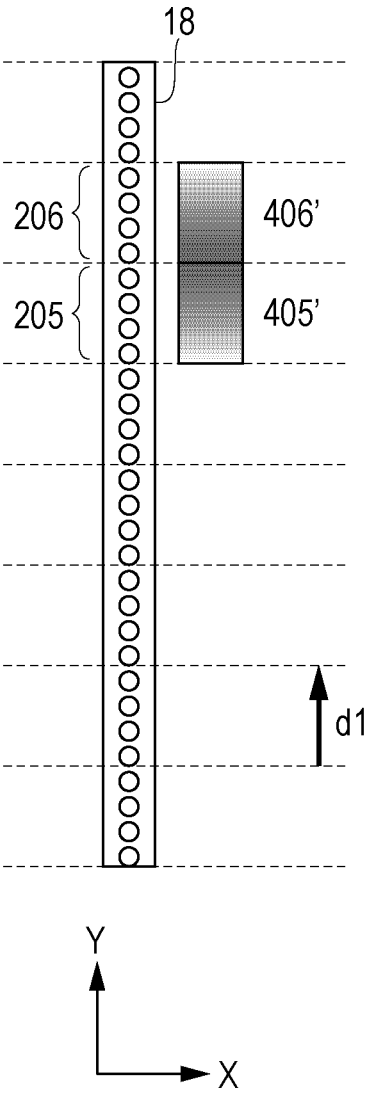
Figure 15A:
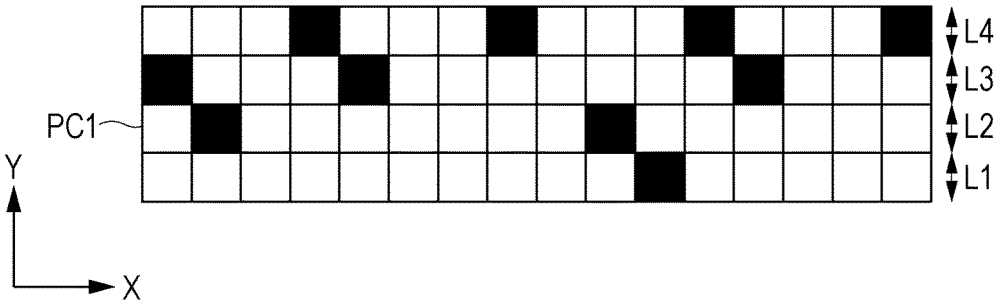
FIGS. 15A to 15D are diagrams illustrating mask patterns used in an embodiment.
Figure 15B:
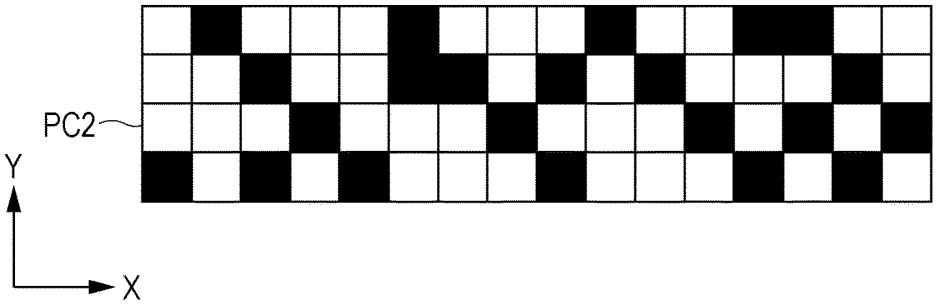
Figure 15C:
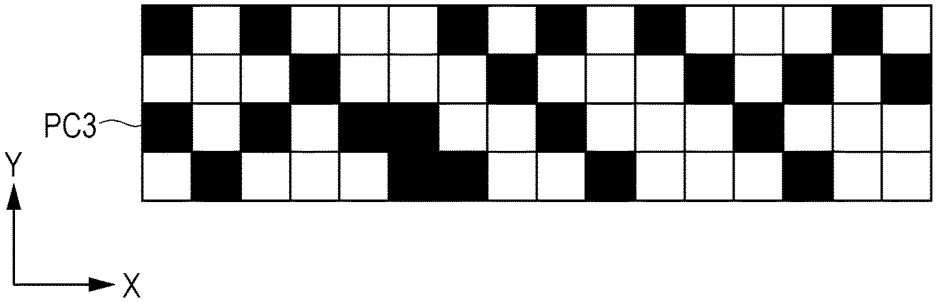
Figure 15D:
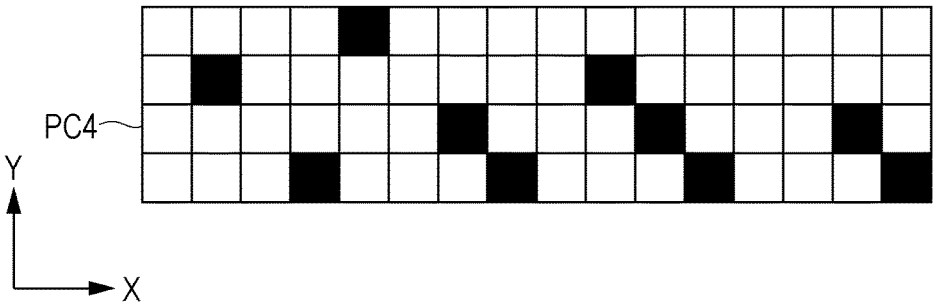

FIGS. 14A and 14B are diagrams for explaining the four-pass printing mode in this embodiment. For the sake of simplification, only the ejection port array 15 for ejecting cyan ink and the ejection port array 18 for ejecting clear ink are illustrated. For ejection port arrays for ejecting color ink other than cyan ink, control similar to that for the ejection port array 15 for ejecting cyan ink is performed. Furthermore, for the sake of simplification, the case where the ejection port arrays each include 32 ejection ports is illustrated.

FIG. 14A is a diagram schematically illustrating ejection port groups within the ejection port array 15 used in the four-pass printing mode and mask patterns used for the ejection port groups. FIG. 14B is a diagram schematically illustrating ejection port groups within the ejection port array 18 used in the four-pass printing mode and mask patterns used for the ejection port groups.

As is clear from FIG. 14A, in the four-pass printing mode in this embodiment, as in the four-pass printing mode in the first embodiment, only the four ejection port groups 201 to 204 within the ejection port array 15 are used for printing for a unit region.

Then, in each of the first to fourth scanning operations for a unit region with conveyance by the distance d1, cyan ink is ejected from the ejection port groups 201 to 204 in accordance with printing data generated using mask patterns 401' to 404', respectively.

In the mask patterns 401' to 404' which are schematically illustrated in FIG. 14A, a darker color indicates a higher print permission ratio, which is a ratio of the number of print permitted pixels to the number of pixels in each region in a mask pattern, and a lighter color indicates a lower print permission ratio. In the mask patterns illustrated in FIG. 14A, a lower print permission ratio is set for a region closer to an end portion of the ejection port array 15.

FIGS. 15A to 15D are diagrams illustrating in detail the mask patterns 401' to 404', respectively. In FIGS. 15A to 15D, black portions represent print permitted pixels for which ink ejection is permitted, and white portions represent print non-permitted pixels for which ink ejection is not permitted. Furthermore, mask patterns each having a size corresponding to 16 pixels in the X direction and 4 pixels in the Y direction, that is, 64 pixels in total, are illustrated. However, the mask patterns may have different sizes in an appropriated manner.

As is clear from FIGS. 15A to 15D, the mask patterns 401' to 404' are arranged such that print permitted pixels are mutually exclusive and complementary to each other. That is, patterns may be obtained such that print permitted pixels are arranged in all the pixels when the logical sum of print permitted pixels in the mask patterns 401' to 404' is obtained.

Furthermore, the print permission ratio of the mask patterns 401' and 404' that correspond to the ejection port groups 201 and 204 which are closer to end portions of the ejection port array among the ejection port groups 201 to 204 is set to be lower than the print permission ratio of the mask patterns 402' and 403' that correspond to the ejection port groups 202 and 203 which are further away from the end portions. For example, for the mask pattern 401' which corresponds to the first scanning operation illustrated in FIG. 15A, 10 of 64 pixels are print permitted pixels. Therefore, the print permission ratio of the mask pattern 401' is about 16% (=10/64*100%). Similarly, the print permission ratio of the mask pattern 404' is about 16%. In contrast, for the mask pattern 402' which corresponds to the second scanning operation illustrated in FIG. 15B, 22 of 64 pixels are print permitted pixels. Therefore, the print permission ratio of the mask pattern 402' is about 34% (=22/64*100%). Similarly, the print permission ratio of the mask pattern 403' is about 34%.

Furthermore, the mask patterns 401' and 404' are set such that the print permission ratio decreases as the position in the Y direction within each mask pattern is closer to an end portion of ejection port groups used for printing. For example, in the mask pattern which corresponds to the first scanning operation illustrated in FIG. 15A, the pixel row L1 which is located on the most upstream side in the Y direction corresponds to an end portion of the ejection port groups 201 to 204. The print permission ratio of the pixel row L1 that is located on the most upstream side in the Y direction is about 6% (=1/16*100%). Furthermore, the print permission ratio of the pixel row L2 which is located on the second most upstream side from an end portion in the Y direction is about 13% (=2/16*100%). Furthermore, the print permission ratio of the pixel row L3 which is located on the second most downstream side from an end portion in the Y direction is about 19% (=3/16*100%). Furthermore, the print permission ratio of the pixel row L4 which is located on the most downstream side in the Y direction is 25% (=4/16*100%). As described above, the mask pattern 401' is set such that the print permission ratio decreases as the position in the Y direction is closer to an end portion of the ejection port groups 201 to 204. The same applied to the mask pattern 404'.

In general, in the case where ink is ejected from a plurality of ejection ports which are arranged continuously in a predetermined direction, it is known that landing position deviation occurs in ink ejected from an ejection port which is located at an end portion due to the influence of airflow or the like. In order to deal with the above, by using a mask pattern which provides a low print permission ratio at an end portion described in this embodiment, a degradation in the image quality caused by the landing position deviation of ink from an ejection port at an end portion described above can be suppressed.

In contrast, as is clear from FIG. 14B, in the four-pass printing mode in this embodiment, as in the four-pass printing mode in the first embodiment, only the two ejection port groups 205 and 206 within the ejection port array 18 for ejecting clear ink are used for printing for a unit region. Then, in each of the first and second scanning operations for a unit region with conveyance by the distance d1, clear ink is ejected from the ejection port groups 205 and 206 in accordance with printing data generated using mask patterns 405' and 406'.

In the mask patterns 405' and 406' which are schematically illustrated in FIG. 14B, a darker color indicates a higher print permission ratio, which is a ratio of the number of print permitted pixels to the number of pixels in each region in a mask pattern, and a lighter color indicates a lower print permission ratio. In the mask patterns illustrated in FIG. 14B, a lower print permission ratio is set for a region closer to an end portion of the ejection port array 15. Explanation for the detailed arrangement of print permitted pixels in the mask patterns 405' and 406' will be omitted.

As described above, also in the four-pass printing mode in this embodiment, an image is printed by ejecting color ink in four scanning operations and then ejecting clear ink in two scanning operations.

(Six-Pass Printing Mode)

Figure 16A:
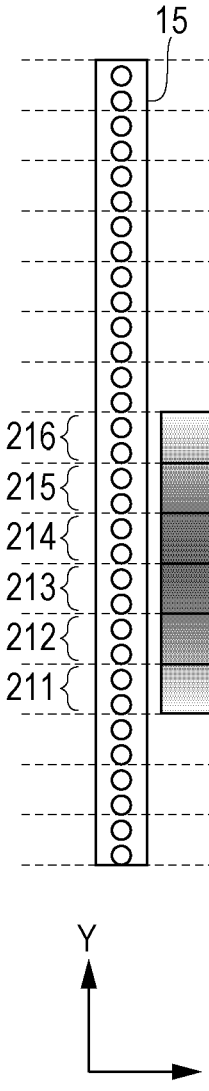
FIGS. 16A and 16B are schematic diagrams illustrating a printing mode in an embodiment.
Figure 16B:
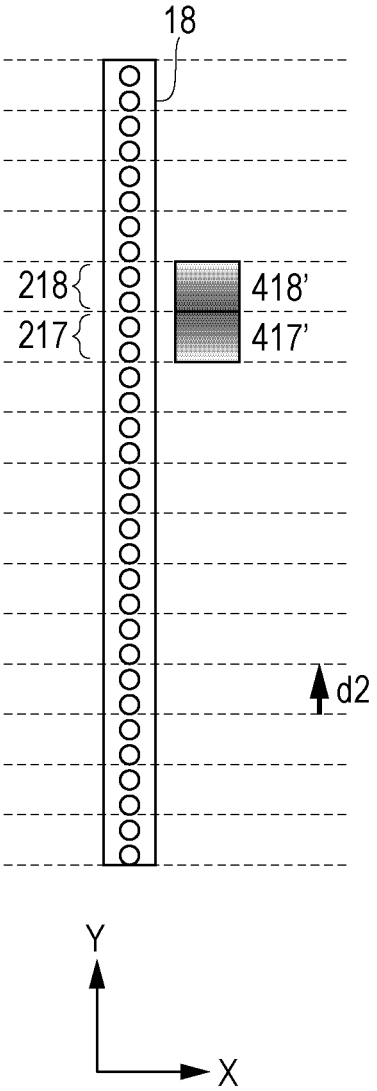

FIGS. 16A and 16B are diagrams for explaining the six-pass printing mode in this embodiment. For the sake of simplification, only the ejection port array 15 for ejecting cyan ink and the ejection port array 18 for ejecting clear ink are illustrated. For ejection port arrays for ejecting color ink other than cyan ink, control similar to that for the ejection port array 15 for ejecting cyan ink is performed. Furthermore, for the sake of simplification, the case where the ejection port arrays each include 32 ejection ports is illustrated.

FIG. 16A is a diagram schematically illustrating ejection port groups within the ejection port array 15 used in the six-pass printing mode and mask patterns used for the ejection port groups. Furthermore, FIG. 16B is a diagram schematically illustrating ejection port groups within the ejection port array 18 used in the six-pass printing mode and mask patterns used for the ejection port groups.

As is clear from FIG. 16A, in the six-pass printing mode in this embodiment, as in the six-pass printing mode in the first embodiment, only the six ejection port groups 211 to 216 within the ejection port array 15 are used for printing for a unit region.

In each of the first to sixth scanning operations for a unit region with conveyance by the distance d2, cyan ink is ejected from the ejection port groups 211 to 216 in accordance with printing data generated using the mask patterns 411' to 416'.

In the mask patterns 411' to 416' which are schematically illustrated in FIG. 16A, a darker color indicates a higher print permission ratio, which is a ratio of the number of print permitted pixels to the number of pixels in each region in a mask pattern, and a lighter color indicates a lower print permission ratio. In the mask patterns illustrated in FIG. 16A, a lower print permission ratio is set for a region closer to an end portion of the ejection port array 15. Explanation for the detailed arrangement of print permitted pixels in the mask patterns 411' to 416' will be omitted.

With the use of such a mask pattern which provides a low print permission ratio at an end portion, a degradation in the image quality caused by the landing position deviation of ink from an ejection port at an end portion described above may be suppressed.

As is clear from FIG. 16B, in the six-pass printing mode in this embodiment, only the two ejection port groups 217 and 218 within the ejection port array 18 for ejecting clear ink are used for printing for a unit region, as in the six-pass printing mode in the first embodiment. In each of the first and second scanning operations for a unit region with conveyance by the distance d2, clear ink is ejected from the ejection port groups 217 and 218 in accordance with printing data generated using mask patterns 417' and 418'.

In the mask patterns 417' and 418' which are schematically illustrated in FIG. 16B, a darker color indicates a higher print permission ratio, which is a ratio of the number of print permitted pixels to the number of pixels in each region in a mask pattern, and a lighter color indicates a lower print permission ratio. In the mask patterns illustrated in FIG. 16B, a lower print permission ratio is set for a region closer to an end portion of the ejection port array 18. Explanation for the detailed arrangement of print permitted pixels in the mask patterns 417' and 418' will be omitted.

As described above, also in the six-pass printing mode in this embodiment, an image is printed by ejecting color ink in six scanning operations and then ejecting clear ink in two scanning operations.

(Variations in Ejection Characteristics by Ink Kogation)

In the case where printing is performed in the above-described four-pass printing mode or six-pass printing mode, as described with reference to FIGS. 14A to 16B, printing is performed only using some ejection ports within the ejection port array 15 for ejecting cyan ink. Therefore, kogation is deposited only on some printing elements which have been used for printing. Furthermore, the print permission ratio of a mask pattern varies according to the position in the Y direction, and therefore the number of ejection times of ink may vary significantly among the ejection port groups used for printing. Thus, the degree of deposition of kogation may vary among the printing elements used for printing.

For example, in the case where printing is performed for a certain printing medium in the four-pass printing mode, a large amount of kogation is deposited on the surface of printing elements that face the ejection port groups 202 and 203 within the ejection port array 15 illustrated in FIGS. 14A and 14B. In contrast, no kogation occurs on the surface of the printing elements that face the ejection ports other than the ejection port groups 201 to 204. Furthermore, for the printing elements that face the ejection port group 201, the degree of deposition of kogation on a more downstream side of a printing element array in the Y direction is smaller. Similarly, for the printing elements that face the ejection port group 204, the degree of deposition of kogation on a more upstream side of a printing element array in the Y direction is smaller. As a result, variations in the ejection speed of ink among ejection ports occur significantly.

After printing for the printing medium is performed, if the one-pass printing mode is selected for printing for the next printing medium, ink is ejected from all the ejection ports. Therefore, unevenness of the density caused by variations in the ejection speed may occur significantly.

(Kogation Nonuniformity Reduction Control)

In view of the above points, also in this embodiment, as in the first embodiment, after printing is performed for a single printing medium in accordance with a certain printing mode, control for reducing nonuniformity of ejection characteristics among printing elements caused by kogation is performed in a different manner depending on the printing mode. In this embodiment, kogation nonuniformity reduction control is performed such that the processing for determining the number of times of preliminary ejection in step S22 and the processing for executing preliminary ejection in step S24 in the flowchart illustrated in FIG. 12 are different from those in the first embodiment.

In step S22, the number of times of preliminary ejection is calculated using equation 2.

Number of times of preliminary ejection=dot count value/number of ejection ports used*maximum value of print permission ratios of mask patterns/average value of print permission ratios of mask patterns*weighting coefficient (Equation 2)

As in the first embodiment, by dividing the dot count value by the number of ejection ports used, the average value of the number of ejection times of ink per ejection port used may be calculated. However, mask patterns used in this embodiment have different print permission ratios depending on the position in the Y direction. Therefore, even if preliminary ejection of ink is performed by the above average value from ejection ports which have not been used for printing, only the average amount of kogation deposited on printing elements which have been used for printing is deposited. In actuality, a larger amount of kogation is deposited on a printing element that faces an ejection port with a large number of ejection times among the printing elements which have been used for printing. Therefore, even if preliminary ejection is performed by the above-mentioned average value, nonuniformity of kogation still remains.

Thus, in this embodiment, the number of times of preliminary ejection for an ejection port which has not been used for printing is set to the maximum value of the number of ejection times for ejection ports which have once been used for printing. In more detail, the average value and the maximum value of the print permission ratios of a plurality of mask patterns used in individual printing modes are calculated. By dividing the above-mentioned average value of the number of ejection times of ink by the average value of the print permission ratios and multiplying the result by the maximum value of the print permission ratios, the maximum value of the number of ejection times of ink may be calculated.

By performing preliminary ejection of ink by the maximum value from an ejection port which has not been used for printing, the number of times of preliminary ejection of ink from the ejection port which has not been used for printing may be made equal to the number of ejection times at the time of printing from an ejection port with a large number of ejection times among ejection ports which have been used for printing. Accordingly, the amount of kogation deposited on the surface of a printing element which faces an ejection port which has not been used for printing may be made substantially equal to the largest amount of kogation deposited on a printing element among printing elements which face ejection ports which have been used for printing.

For example, the print permission ratios of the mask patterns 401', 402', 403', and 404' used in the four-pass printing mode in this embodiment are about 16%, about 34%, about 34%, and about 16%, respectively, as described above. Therefore, the average value of the print permission ratios is about 25%, and the maximum value of the print permission ratios is about 34%. Accordingly, the maximum value of the number of ejection times of ink in the four-pass printing mode in this embodiment may be calculated by multiplying the average value of the number of ejection times of ink by 1.36 (=34/25).

Then, as in the first embodiment, by multiplying the above-mentioned maximum value by a weighting coefficient, the actual number of times of preliminary ejection is determined. Also in this embodiment, it is understood that unevenness of the density is difficult to visually recognize if substantially half the amount of kogation deposited on a printing element which faces an ejection port which has been used is deposited, and therefore a value of 0.5 is set as the weighting coefficient.

In step S24, preliminary ejection of ink is performed once by using a preliminary ejection pattern which corresponds to a printing mode at the time of printing in step S12. In this embodiment, preliminary ejection patterns which are different from the preliminary ejection patterns used in the first embodiment illustrated in FIGS. 13A and 13B are used.

Figure 17A:
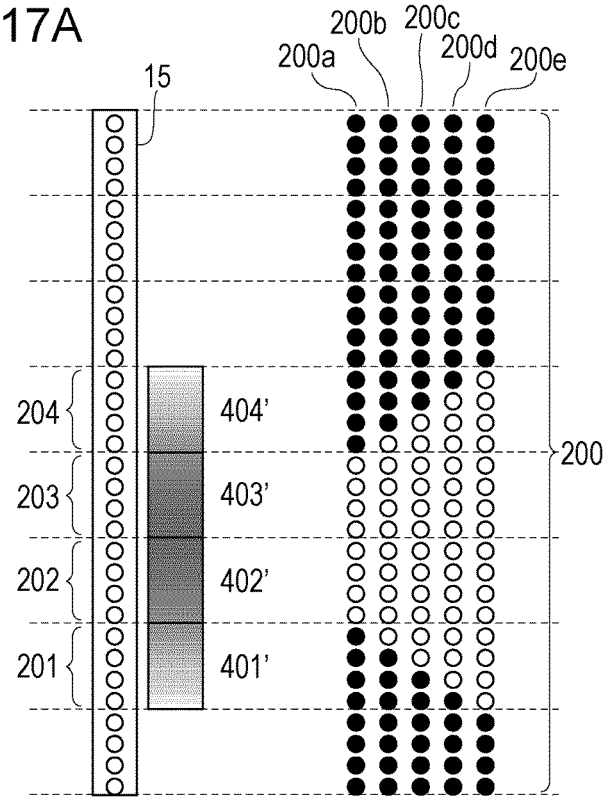
FIGS. 17A and 17B are diagrams for explaining preliminary ejection patterns in an embodiment.
Figure 17B:
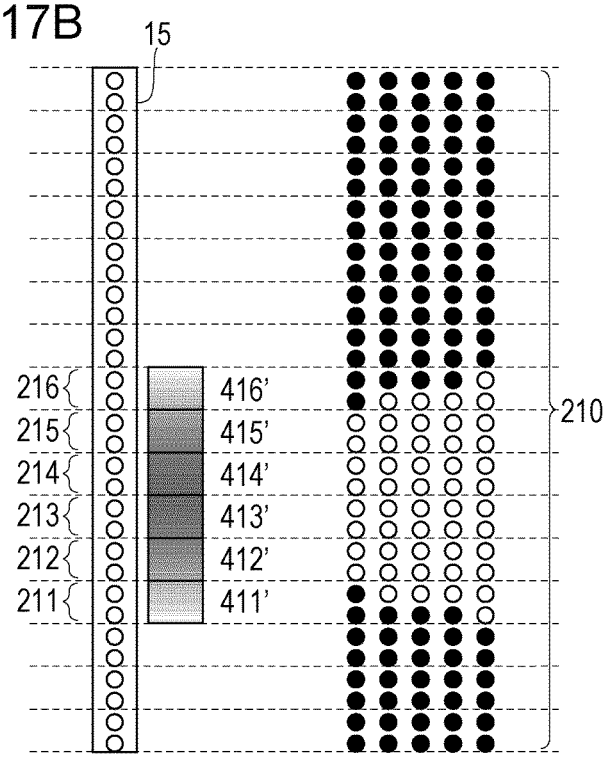

FIG. 17A is a diagram illustrating a preliminary ejection pattern 200 which is used in step S24 in the case where printing is performed in the four-pass printing mode. FIG. 17B is a diagram illustrating a preliminary ejection pattern 210 which is used in step S24 in the case where printing is performed in the six-pass printing mode. In the preliminary ejection patterns 200 and 210 illustrated in FIGS. 17A and 17B, black portion represent ejection ports from which preliminary ejection is performed, and white portions represent ejection ports from which preliminary ejection is not performed.

In this embodiment, a preliminary ejection pattern including five patterns per printing mode is set. For example, the preliminary ejection pattern 210 for the four-pass printing mode includes patterns 200*a*, 200*b*, 200*c*, 200*d*, and 200*e*. In step S24 in this embodiment, in the case where printing is performed in the four-pass printing mode, preliminary ejection is performed by sequentially using the patterns 200*a* to 200*e*. In more detail, preliminary ejection is performed by using the pattern 200*a* when the remainder obtained by dividing the counter value N by 5 is 0, using the pattern 200*b* when the remainder is 1, using the pattern 200*c* when the remainder is 2, using the pattern 200*d* when the remainder is 3, and using the pattern 200*e* when the remainder is 4.

For example, in the case where preliminary ejection is performed in step S24 for the first time since start of the kogation nonuniformity reduction control, the counter value N is set to 0 in step S21. At this time, the remainder obtained by dividing the counter value N=0 by 5 is 0, and therefore preliminary ejection is performed by using the pattern 200*a*.

Next, in the case where preliminary ejection is performed in step S24, since the counter value N has been incremented by one in step S25, the counter value N is set to 1. In this case, the remainder obtained by dividing the counter value N=1 by 5 is 1, and therefore preliminary ejection is performed using the pattern 200*b*.

Each of the five patterns constituting a preliminary ejection pattern in this embodiment is set such that preliminary ejection of ink is performed from all the ejection ports that have not been used for printing.

Furthermore, the five patterns constituting a preliminary ejection pattern in this embodiment are set such that preliminary ejection of ink is performed a larger number of times from an ejection port which corresponds to a mask pattern with a lower print permission ratio among ejection ports which have been used for printing. Accordingly, the amount of kogation deposited on the surface of a printing element that faces an ejection port with a small number of ejection times among ejection ports which have been used for printing may be made closer to the amount of kogation deposited on the surface of a printing element that faces an ejection port with a large number of ejection times.

For example, the patterns 200*a* to 200*e* are set in the four-pass printing mode such that ink is ejected from all the ejection ports other than the ejection port groups 201 to 204 within the ejection port array 15 for ejecting cyan ink that are not used for printing.

Furthermore, the ejection port corresponding to the pixel row L1 with the lowest print permission ratio (about 6%) that is located on the most upstream side in the Y direction within the ejection port group 201 that corresponds to a mask pattern with a low print permission ratio among ejection ports used for printing, is set such that ink is ejected using the patterns 200*a*, 200*b*, 200*c*, and 200*d* and ink is not ejected using the pattern 200*e*. That is, with the preliminary ejection pattern 200, in the case where preliminary ejection is performed five times in step S24, preliminary ejection is performed four times.

Furthermore, the ejection port corresponding to the pixel row L4 with the highest print permission ratio (about 25%) that is located on the most downstream side in the Y direction within the ejection port group 201 that corresponds to a mask pattern with a low print permission ratio of the ejection ports used for printing, is set such that ink is ejected using the pattern 200*a* and ink is not ejected using the patterns 200*b*, 200*c*, 200*d*, and 200*e*. That is, with the preliminary ejection pattern 200, in the case where preliminary ejection is performed five times in step S24, preliminary ejection is performed once.

The preliminary ejection pattern 210 in the six-pass printing mode is set in a manner similar to the preliminary ejection pattern 200 in the four-pass printing mode.

As described above, the method for calculating the number of times of preliminary ejection in step S22 and the preliminary ejection patterns used in step S24 in this embodiment differ from those in the first embodiment. Accordingly, even in the case where a mask pattern which is set such that the print permission ratio varies according to the position in the Y direction is used, the amount of kogation deposited may be substantially constant among printing elements in each printing mode, and a degradation in the image quality caused by variations in the ejection characteristics within an ejection port array may be suppressed.

In this embodiment, a configuration has been described in which the number of times of preliminary ejection is determined in accordance with equation 2 in step S22 and ejection is performed only once in accordance with a single pattern in a single preliminary ejecting operation in step S24. However, other configurations are also possible.

For example, in the case where printing is performed in the four-pass printing mode, ink may be ejected five times in accordance with the patterns 200*a* to 200*e* in a single preliminary ejecting operation in step S24. In this case, preliminary ejecting operation may be performed in step S24 the number of times obtained by dividing the number of times of preliminary ejection of ink calculated using equation 2 by 5, which is the number of ejection times per preliminary ejecting operation.

Third Embodiment

In the first and second embodiments described above, a configuration is described in which printing is performed for a printing medium in accordance with one of a plurality of printing modes.

In a third embodiment, a configuration will be described in which printing is performed for a printing medium in different printing modes depending on the region for which printing is performed.

Explanation for parts similar to those in the first and second embodiments will be omitted.

Figure 18A:
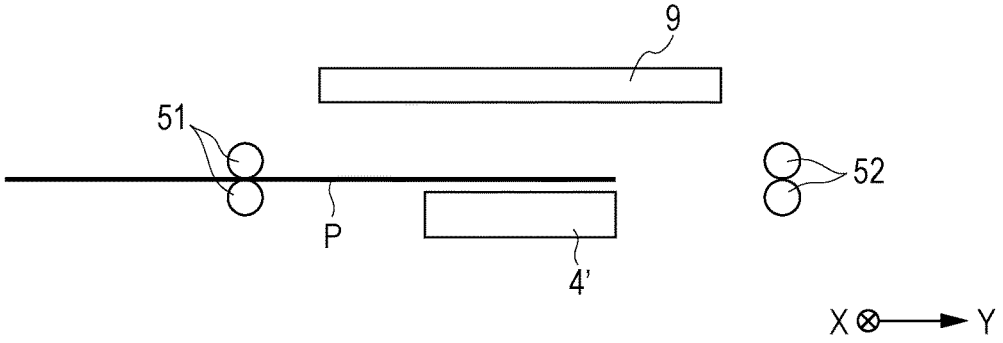
FIGS. 18A to 18C are schematic diagrams illustrating the internal configuration of an image printing apparatus according to an embodiment.
Figure 18B:
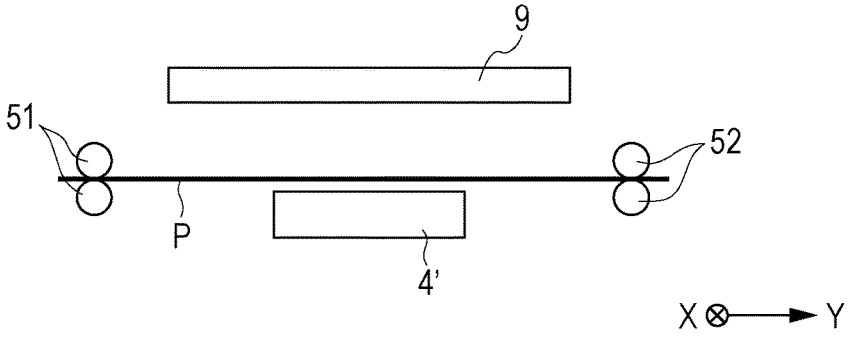
Figure 18C:
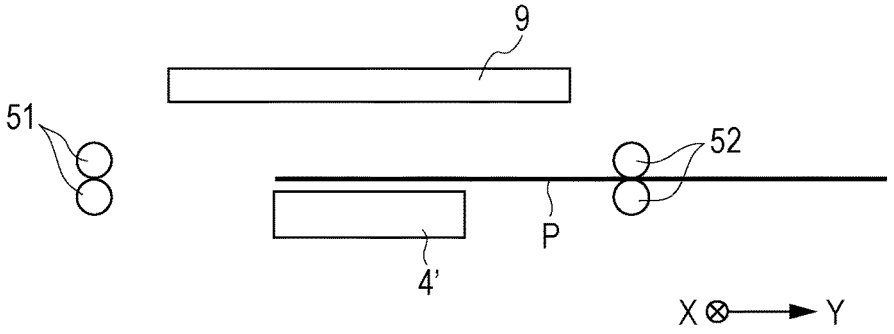

FIGS. 18A, 18B, and 18C are diagrams schematically illustrating an internal configuration of a portion near a printing head of an ink jet printing apparatus according to this embodiment. FIG. 18A is a schematic diagram illustrating the relative position of a printing medium P inside the ink jet printing apparatus in the case where printing is performed for an end portion on a downstream side of the printing medium P in the Y direction (hereinafter, may also be referred to as a leading end portion). FIG. 18B is a schematic diagram illustrating the relative position of the printing medium P inside the ink jet printing apparatus in the case where printing is performed for a region other than the downstream side end portion of the printing medium P in the Y direction and an upstream side end portion of the printing medium P in the Y direction (hereinafter, may also be referred to as a central portion). FIG. 18C is a schematic diagram illustrating the relative position of the printing medium inside the ink jet printing apparatus in the case where printing is performed for the end portion on the upstream side of the printing medium P in the Y direction (hereinafter, may also be referred to as a trailing end portion).

When ink is ejected from the printing head 9, distortion may occur in the printing medium P, and the distortion may cause a landing error of ink. In view of the above, a platen 4' having a suction hole (not illustrated in figures) which sucks a printing medium is provided. By executing suction in the state in which the printing medium P covers the platen 4', causing the printing medium P to be adsorbed onto the platen 4', and ejecting ink from the printing head, the occurrence of the landing error of ink caused by the above distortion may be reduced.

As described above, in this embodiment, the printing medium P needs to cover the platen 4' in the case where ink is ejected. Therefore, in the case where printing for the printing medium P starts, at the time of printing for a leading end portion of the printing medium, the printing medium P is conveyed at least to a position illustrated in FIG. 18A, and then ink is ejected. Similarly, in the case where printing for a trailing end portion of the printing medium P is performed, at the time of completion of the printing for the printing medium P, the printing medium P also needs to cover the platen 4'. Therefore, the printing medium P needs to be located at least at a position illustrated in FIG. 18C.

The ink jet printing apparatus according to this embodiment includes a first conveyance roller pair 51 and a second conveyance roller pair 52 for pinching and rotating the printing medium P to convey the printing medium P. The first conveyance roller pair 51 is provided on an upstream side in the Y direction relative to the printing head 9, and the second conveyance roller pair 52 is provided on a downstream side in the Y direction relative to the printing head 9.

For printing for a central portion of the printing medium as illustrated in FIG. 18B, the printing medium P is conveyed while being pinched between the first conveyance roller pair 51 and the second conveyance roller pair 52. However, for example, for printing for the leading end portion of the printing medium P as illustrated in FIG. 18A, the printing medium P is conveyed by being held by the first conveyance roller pair 51 but not being held by the second conveyance roller pair 52. In contrast, for printing for the trailing end portion of the printing medium P as illustrated in FIG. 18C, the printing medium P is conveyed by being held by the second conveyance roller pair 52 but not being held by the first conveyance roller pair 51.

In the case where the printing medium P is held only by a single conveyance roller pair as illustrated in FIG. 18A or 18C, conveyance deviation is more likely to occur in the printing medium P than the case where the printing medium P is pinched between two conveyance roller pairs as illustrated in FIG. 18B. In the case where such conveyance deviation occurs in the printing medium P, ink is not provided to a desired position, which may cause a degradation in the image quality.

In this embodiment, in the case where printing is performed for the leading end portion and the trailing end portion of the printing medium P, the amount of conveyance of the printing medium P between print scanning operations in the multipass printing method is smaller than the case where printing is performed for the central portion. By reducing the amount of conveyance per scanning operation, even if conveyance deviation occurs in the printing medium P, the influence of the conveyance deviation may be reduced.

However, in the case where the amount of conveyance between print scanning operations is reduced, the width of a unit region on the printing medium P in the Y direction is also reduced. In accordance with this, in the case where printing is performed for the leading end portion and the trailing end portion of the printing medium P, the number of ejection ports from which ink is ejected is smaller than the case where printing is performed for the central portion.

Furthermore, since the printing medium P needs to cover the platen 4' for printing, ink needs to be ejected from different ejection ports between the case where printing is performed for the leading end portion of the printing medium P and the case where printing is performed for the trailing end portion of the printing medium P. For example, as is clear from FIG. 18A, for printing for the leading end portion, ink is ejected from an ejection port which is located on the downstream side of the printing head 9 in the Y direction. In contrast, as is clear from FIG. 18C, for printing for the trailing end portion, ink is ejected from an ejection port which is located on the upstream side of the printing head 9 in the Y direction.

Therefore, in the case where printing is performed for the leading end portion, the trailing end portion, and the central portion of the printing medium P, different ejection ports are used for printing. Thus, when printing is completed, the degree of deposition of kogation varies according to the printing condition under which printing is performed for the leading end portion, the trailing end portion, and the central portion.

In view of the above, the kogation nonuniformity reduction control at the time of completion of printing is performed in a different manner depending on the printing condition under which printing is performed for a region of the printing medium.

Hereinafter, a leading end portion printing mode and a trailing end portion printing mode in this embodiment will be described in detail. In a central portion printing mode in this embodiment, printing is performed in accordance with the four-pass printing mode illustrated in FIGS. 14A and 14B in the second embodiment. Therefore, explanation for the central portion printing mode will be omitted.

(Leading End Portion Printing Mode)

Figures 19A, 19B:
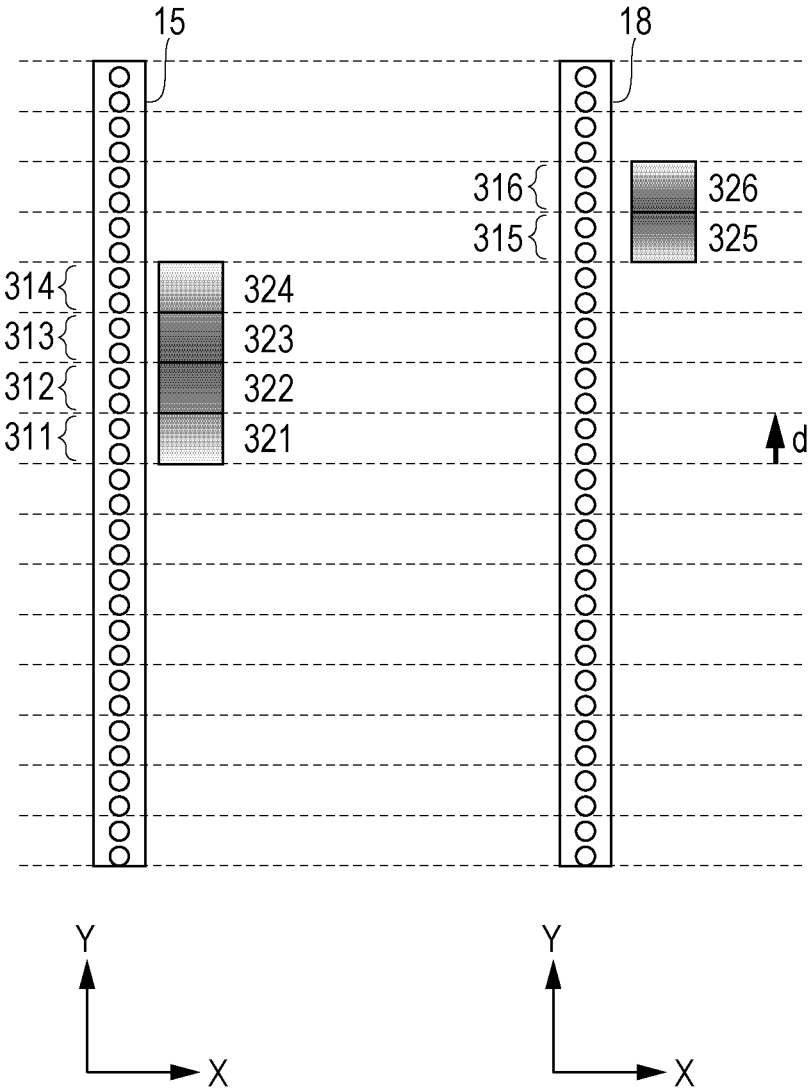
FIGS. 19A and 19B are schematic diagrams illustrating a printing mode in an embodiment.

FIGS. 19A and 19B are diagrams for explaining the leading end portion printing mode in this embodiment. For the sake of simplification, only the ejection port array 15 for ejecting cyan ink and the ejection port array 18 for ejecting clear ink are illustrated. For ejection port arrays for ejecting color ink other than cyan ink, control similar to that for the ejection port array 15 for ejecting cyan ink is performed. Furthermore, for the sake of simplification, the case where the ejection port arrays each include 32 ejection ports is illustrated.

FIG. 19A is a diagram schematically illustrating ejection port groups within the ejection port array 15 used in the leading end portion printing mode and mask patterns used for the ejection port groups. FIG. 19B is a diagram schematically illustrating ejection port groups within the ejection port array 18 used in the leading end portion printing mode and mask patterns used for the ejection port groups.

As is clear from FIG. 19A, in the leading end portion printing mode in this embodiment, only four ejection port groups 311 to 314 within the ejection port array 15 are used for printing for a unit region. As illustrated in FIG. 18A, at the start of printing for the leading end portion, the leading end portion of the printing medium P needs to face an ejection port which is located on the downstream side of the printing head in the Y direction. Thus, in the leading end portion printing mode, printing is performed using the ejection port groups 311 to 314 which are located on the downstream side in the Y direction.

Then, in the first to fourth scanning operations for a unit region with conveyance by the distance d3, cyan ink is ejected from the ejection port groups 311 to 314 in accordance with printing data generated using the mask patterns 321 to 324. As described above, in the leading end portion printing mode, the amount of conveyance is smaller than the central portion printing mode, and therefore the distance d3 is shorter than the distance d1.

In the mask patterns 321 to 324 which are schematically illustrated in FIG. 19A, a darker color indicates a higher print permission ratio, which is a ratio of the number of print permitted pixels to the number of pixels in each region in a mask pattern, and a lighter color indicates a lower print permission ratio. In the mask patterns illustrated in FIG. 19A, a lower print permission ratio is set for a region closer to an end portion of the ejection port array 15. Explanation for the detailed arrangement of print permitted pixels in the mask patterns 321 to 324 will be omitted.

As is clear from FIG. 19B, in the leading end portion printing mode in this embodiment, only the two ejection port groups 315 and 316 within the ejection port array 18 for ejecting clear ink are used for printing for a unit region. Then, in each of the first and second scanning operations for a unit region with conveyance by the distance d3, clear ink is ejected from the ejection port groups 315 and 316 in accordance with printing data generated using the mask patterns 325 and 326.

In the mask patterns 325 and 326 which are schematically illustrated in FIG. 19B, a darker color indicates a higher print permission ratio, which is a ratio of the number of print permitted pixels to the number of pixels in each region in a mask pattern, and a lighter color indicates a lower print permission ratio. In the mask patterns illustrated in FIG. 19B, a lower print permission ratio is set for a region closer to an end portion of the ejection port array 18. Explanation for the detailed arrangement of print permitted pixels in the mask patterns 325 and 326 will be omitted.

As described above, in the leading end portion printing mode in this embodiment, as in the central portion printing mode, an image is printed by ejecting color ink in four scanning operations and then ejecting clear ink in two scanning operations. However, in the leading end portion printing mode, printing is performed using printing elements whose number is smaller than printing elements used in the central portion printing mode. Furthermore, in the leading end portion printing mode, printing is performed using printing elements on the downstream side in the Y direction compared to the central portion printing mode.

(Trailing End Portion Printing Mode)

Figure 20A:
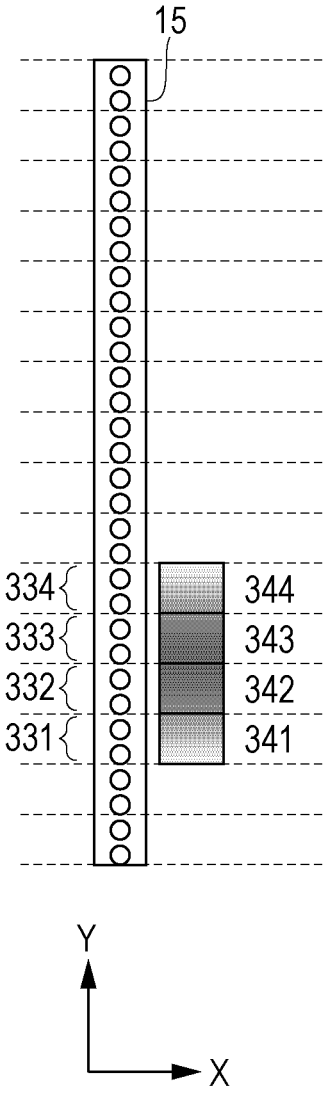
FIGS. 20A and 20B are schematic diagrams illustrating a printing mode in an embodiment.
Figure 20B:
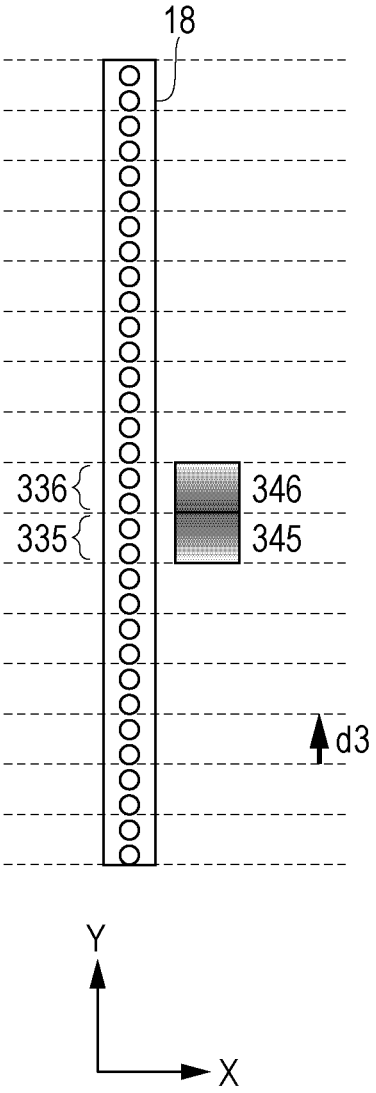

FIGS. 20A and 20B are diagrams for explaining the trailing end portion printing mode in this embodiment. For the sake of simplification, only the ejection port array 15 for ejecting cyan ink and the ejection port array 18 for ejecting clear ink are illustrated. For ejection port arrays for ejecting color ink other than cyan ink, control similar to that for the ejection port array 15 for ejecting cyan ink is performed. Furthermore, for the sake of simplification, the case where the ejection port arrays each include 32 ejection ports is illustrated.

FIG. 20A is a diagram schematically illustrating ejection port groups within the ejection port array 15 used in the trailing end portion printing mode and mask patterns used for the ejection port groups. FIG. 20B is a diagram schematically illustrating ejection port groups within the ejection port array 18 used in the trailing end portion printing mode and mask patterns used for the ejection port groups.

As is clear from FIG. 20A, in the trailing end portion printing mode in this embodiment, only the four ejection port groups 331 to 334 within the ejection port array 15 are used for printing for a unit region. As illustrated in FIG. 18C, at the start of printing for the trailing end portion, the trailing end portion of the printing medium P needs to face an ejection port which is located on the upstream side of the printing head in the Y direction. Thus, in the trailing end portion printing mode, printing is performed using the ejection port groups 331 to 334 which are located on the upstream side in the Y direction.

Then, in the first to fourth scanning operations for a unit region with conveyance by the distance d3, cyan ink is ejected from the ejection port groups 331 to 334 in accordance with printing data generated using the mask patterns 341 to 344. In the trailing end portion printing mode, as in the leading end portion printing mode, the amount of conveyance is smaller than the central portion printing mode, and therefore the distance d3 is shorter than the distance d1.

In the mask patterns 341 to 344 which are schematically illustrated in part FIG. 20A, a darker color indicates a higher print permission ratio, which is a ratio of the number of print permitted pixels to the number of pixels in each region in a mask pattern, and a lighter color indicates a lower print permission ratio. In the mask patterns illustrated in FIG. 20A, a lower print permission ratio is set for a region closer to an end portion of the ejection port array 15. Explanation for the detailed arrangement of print permitted pixels in the mask patterns 341 to 344 will be omitted.

As is clear from FIG. 20B, in the trailing end portion printing mode in this embodiment, only the two ejection port groups 335 and 336 within the ejection port array 18 for ejecting clear ink are used for printing for a unit region. Then, in each of the first and second scanning operations for a unit region with conveyance by the distance d3, clear ink is ejected from the ejection port groups 335 and 336 in accordance with printing data generated using the mask patterns 345 and 346.

In the mask patterns 345 and 346 which are schematically illustrated in FIG. 20B, a darker color indicates a higher print permission ratio, which is a ratio of the number of print permitted pixels to the number of pixels in each region in a mask pattern, and a lighter color indicates a lower print permission ratio. In the mask patterns illustrated in FIG. 20B, a lower print permission ratio is set for a region closer to an end portion of the ejection port array 18. Explanation for the detailed arrangement of print permitted pixels in the mask patterns 345 and 346 will be omitted.

As described above, in the trailing end portion printing mode in this embodiment, as in the central portion printing mode, an image is printed by ejecting color ink in four scanning operations and then ejecting clear ink in two scanning operations. However, in the trailing end portion printing mode, printing is performed using printing elements whose number is smaller than printing elements used in the central portion printing mode. Furthermore, in the trailing end portion printing mode, printing is performed using printing elements on the upstream side in the Y direction compared to the central portion printing mode and the leading end portion printing mode.

(Kogation Nonuniformity Reduction Control)

In this embodiment, after printing is performed for a single printing medium in accordance with the above-described three printing modes: the leading end portion printing mode, the central portion printing mode, and the trailing end portion printing mode, in accordance with the position of the printing medium, control for reducing nonuniformity of ejection characteristics among printing elements caused by kogation is performed in a different manner depending on the printing mode.

Figure 21:
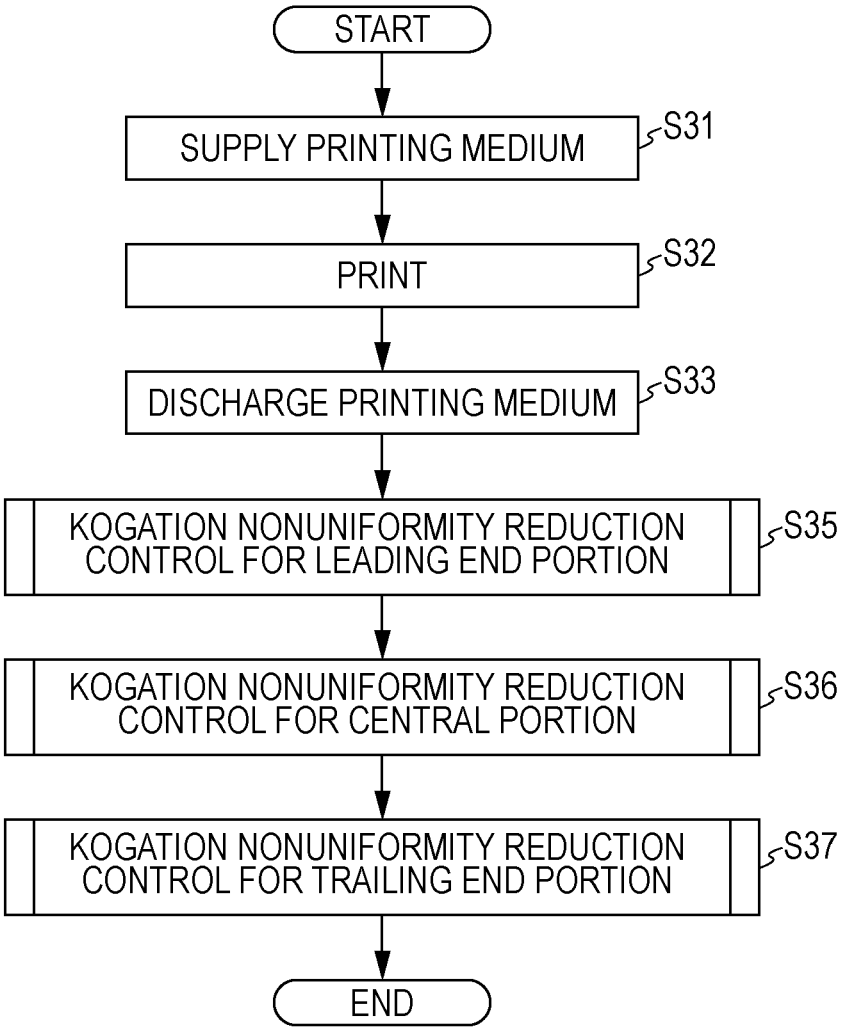
FIG. 21 is a diagram illustrating a process until execution of kogation nonuniformity reduction control in an embodiment.

FIG. 21 is a flowchart of control for determining whether or not to execute control for reducing nonuniformity of kogation, the control being performed by the CPU in accordance with a control program according to this embodiment.

Steps S31 to S33 are similar to steps S11 to S13 illustrated in FIG. 11, and therefore explanation for steps S31 to S33 will be omitted.

In steps S35, S36, and S37, kogation nonuniformity reduction control for the leading end portion, kogation nonuniformity reduction control for the central portion, and kogation nonuniformity reduction control for the trailing end portion, which will be described below, are performed.

Figure 22A:
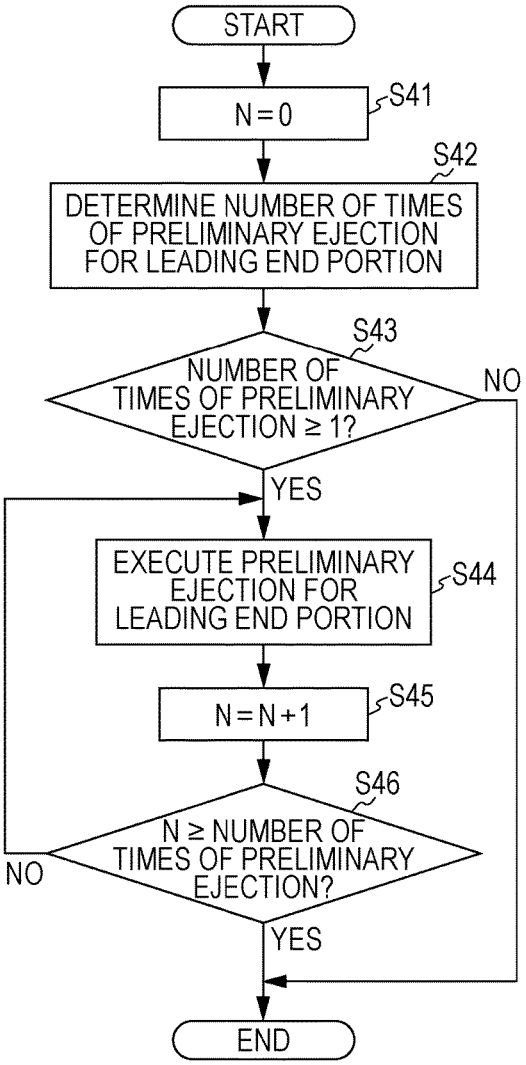
FIGS. 22A to 22C are diagrams for explaining processing processes of kogation nonuniformity reduction control in an embodiment.
Figure 22B:
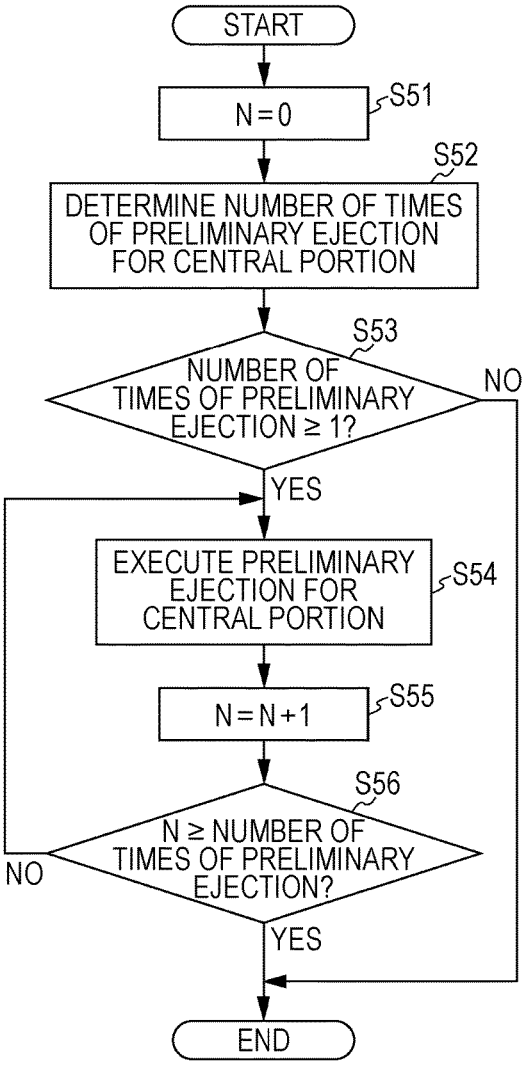
Figure 22C:
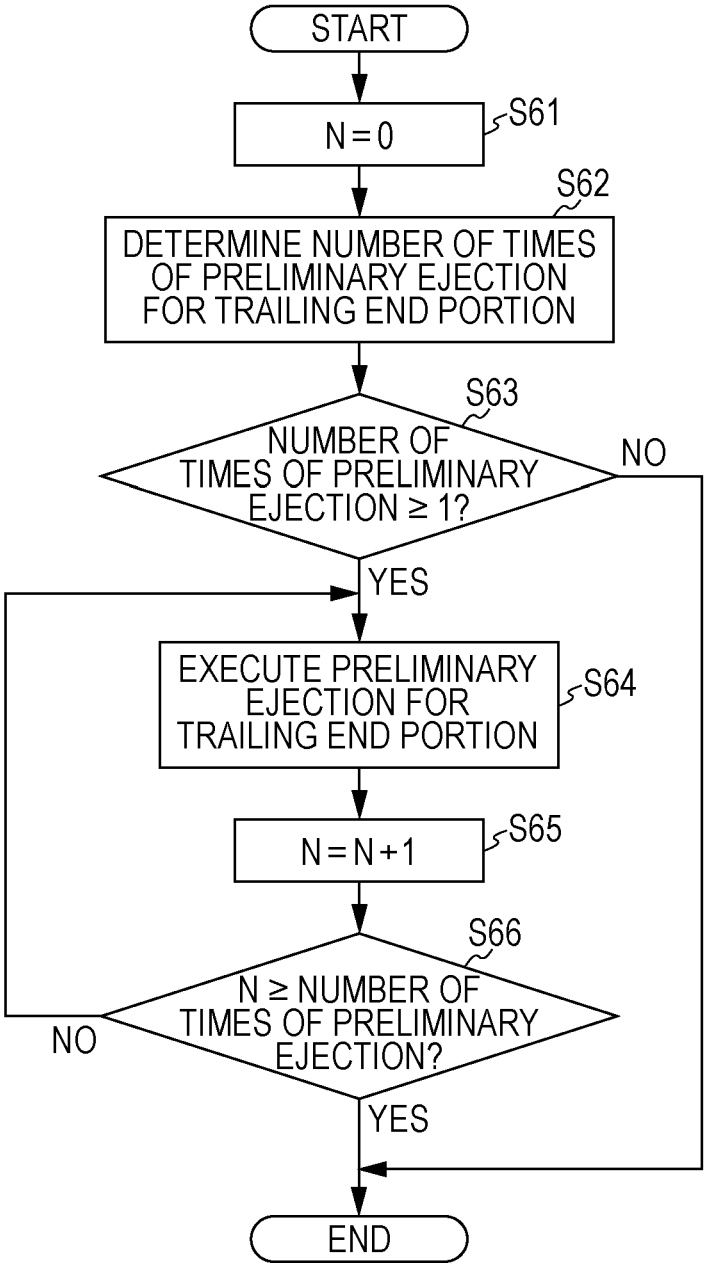

FIGS. 22A, 22B, and 22C are flowcharts of kogation nonuniformity reduction control which is performed by the CPU in accordance with a control program according to this embodiment. FIG. 22A illustrates kogation nonuniformity reduction control for the leading end portion, FIG. 22B illustrates kogation nonuniformity reduction control for the central portion, and FIG. 22C illustrates kogation nonuniformity reduction control for the trailing end portion.

Steps other than steps S42 and S44 in FIG. 22A, steps other than steps S52 and S54 in FIG. 22B, and steps other than steps S62 and S64 in FIG. 22C are the same as steps in FIG. 12. Therefore, explanation for those same steps will be omitted.

In step S42 of the kogation nonuniformity reduction control for the leading end portion illustrated in FIG. 22A, the number of times of preliminary ejection is calculated using equation 2. Here, in order to obtain the number of times of preliminary ejection in the leading end portion printing mode, the dot count value, the number of ejection ports used, the maximum value of print permission ratios of mask patterns, and the average value of print permission ratios of mask patterns in equation 2 adopt values in the leading end portion printing mode.

Figure 23A:
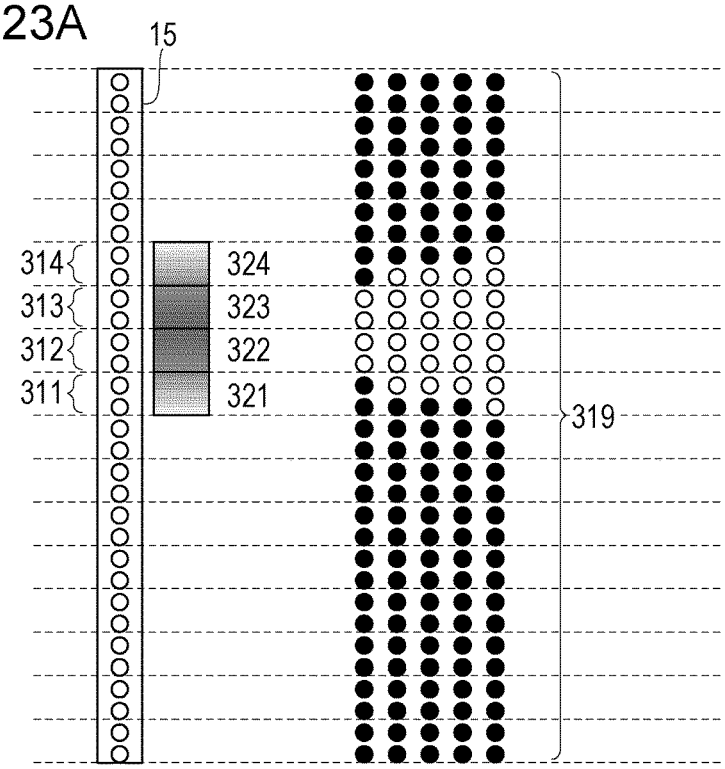
FIGS. 23A and 23B are diagrams for explaining preliminary ejection patterns in an embodiment.

Next, in step S44 in the kogation nonuniformity reduction control for the leading end portion illustrated in FIG. 22A, preliminary ejection of ink is performed once using a predetermined preliminary ejection pattern. FIG. 23A illustrates a preliminary ejection pattern 319 which is used in step S44 of the kogation nonuniformity reduction control for the leading end portion. In the preliminary ejection pattern 319 illustrated in FIG. 23A, black portions represent ejection ports from which preliminary ejection is performed, and white portions represent ejection ports from which preliminary ejection is not performed.

In the kogation nonuniformity reduction control for the leading end portion in this embodiment, the preliminary ejection pattern 319 including five patterns is set. In this embodiment, as in the preliminary ejection patterns illustrated in FIGS. 17A and 17B, preliminary ejection is performed using different patterns depending on the remainder obtained by dividing the counter value N by 5. This operation is similar to that described in the second embodiment. Therefore, explanation for this operation will be omitted.

Each of the five patterns constituting a preliminary ejection pattern in this embodiment is set such that preliminary ejection of ink is performed from all the ejection ports which have not been used for printing.

Furthermore, the five patterns constituting a preliminary ejection pattern in this embodiment are set such that preliminary ejection of ink is performed a larger number of times from an ejection port which corresponds to a mask pattern with a lower print permission ratio among ejection ports which have been used for printing in the leading end portion printing mode. Accordingly, the amount of kogation deposited on the surface of a printing element that faces an ejection port with a small number of ejection times among ejection ports which have been used for printing in the leading end portion printing mode may be made closer to the amount of kogation deposited on the surface of a printing element that faces an ejection port with a large number of ejection times.

In step S52 in the kogation nonuniformity reduction control for the central portion illustrated in FIG. 22B, the number of times of preliminary ejection is calculated using equation 2. Here, in order to obtain the number of times of preliminary ejection in the central portion printing mode, the dot count value, the number of ejection ports used, the maximum value of print permission ratios of mask patterns, and the average value of print permission ratios of mask patterns in equation 2 adopt values in the central portion printing mode.

Next, in step S54 in the kogation nonuniformity reduction control for the central portion illustrated in FIG. 22B, preliminary ejection of ink is performed once using a predetermined preliminary ejection pattern. Here, preliminary ejection is performed using the preliminary ejection pattern 200 illustrated in FIG. 17A as a preliminary ejection pattern.

In step S62 of the kogation nonuniformity reduction control for the trailing end portion illustrated in FIG. 22C, the number of times of preliminary ejection is calculated using equation 2. Here, in order to obtain the number of times of preliminary ejection in the trailing end portion printing mode, the dot count value, the number of ejection ports used, the maximum value of print permission ratios of mask patterns, and the average value of print permission ratios of mask patterns in equation 2 adopt values in the trailing end portion printing mode.

Figure 23B:
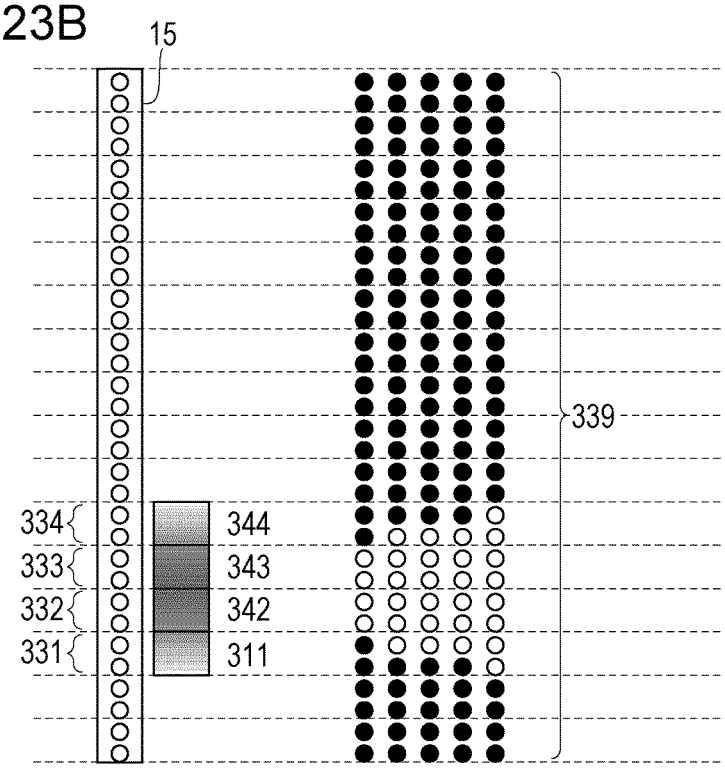

Next, in step S64 in the kogation nonuniformity reduction control for the trailing end portion illustrated in FIG. 22C, preliminary ejection of ink is performed once using a predetermined preliminary ejection pattern. FIG. 23B illustrates a preliminary ejection pattern 339 which is used in step S64 of the kogation nonuniformity reduction control for the trailing end portion. In the preliminary ejection pattern 339 illustrated in FIG. 23B, black portions represent ejection ports from which preliminary ejection is performed, and white portions represent ejection ports from which preliminary ejection is not performed.

In the kogation nonuniformity reduction control for the trailing end portion in this embodiment, the preliminary ejection pattern 339 including five patterns is set. In this embodiment, as in the preliminary ejection patterns illustrated in FIGS. 17A and 17B, preliminary ejection is performed using different patterns depending on the remainder obtained by dividing the counter value N by 5. This operation is similar to that described in the second embodiment. Therefore, explanation for this operation will be omitted.

Each of the five patterns constituting a preliminary ejection pattern in this embodiment is set such that preliminary ejection of ink is performed from all the ejection ports which have not been used for printing.

Furthermore, the five patterns constituting a preliminary ejection pattern in this embodiment are set such that preliminary ejection of ink is performed a larger number of times from an ejection port which corresponds to a mask pattern with a lower print permission ratio among ejection ports which have been used for printing in the trailing end portion printing mode. Accordingly, the amount of kogation deposited on the surface of a printing element that faces an ejection port with a small number of ejection times among ejection ports which have been used for printing in the trailing end portion printing mode may be made closer to the amount of kogation deposited on the surface of a printing element that faces an ejection port with a large number of ejection times.

With the configuration described above, even in the case where printing is performed in different printing modes depending on the region for which printing is performed, printing may be performed while a degradation in the image quality caused by occurrence of nonuniformity of kogation among printing elements being suppressed.

In the third embodiment, a configuration has been described in which with the use of a platen for sucking a printing medium, a printing element on the downstream side in the Y direction is used for printing for the leading end portion and a printing element on the upstream side in the Y direction is used for printing for the trailing end portion. However, other configurations are also possible. For example, in the case where no suction platen is provided, for printing for the leading end portion, the printing medium P is held only by the first conveyance roller pair illustrated in FIG. 18A. Therefore, if the printing medium P is conveyed to the position illustrated in FIG. 18A, the leading end portion of the printing medium may be slightly bent downwards in the vertical direction. In this case, printing for the leading end portion may be performed on the upstream side in the Y direction relative to the location of the leading end portion illustrated in FIG. 18A. At this time, printing for the leading end portion is performed from a printing element on the upstream side in the Y direction. Similarly, printing for the trailing end portion may be performed from a printing element on the downstream side in the Y direction. In the kogation nonuniformity reduction control in this embodiment, at this time, by executing preliminary ejection using the preliminary ejection patterns illustrated in FIGS. 20A and 20B in the leading end portion printing mode and using the preliminary ejection patterns illustrated in FIGS. 19A and 19B in the trailing end portion printing mode, effects in this embodiment may be achieved.

Fourth Embodiment

In the first to third embodiments described above, a configuration has been described in which kogation nonuniformity reduction control is performed even when printing proceeds.

In a fourth embodiment, a configuration will be described in which kogation nonuniformity reduction control is not performed after a certain point in time.

Explanation for parts similar to those in the first to third embodiments described above will be omitted.

As is clear from FIG. 10, the amount of kogation deposited on the surface of a printing element increases as the number of ejection times of ink increases even with ink having a high polarity, and therefore there is very little change in the ejection speed. Thus, in this embodiment, a predetermined threshold Th_A is set. When the number of ejection times of ink is smaller than the threshold Th_A, kogation nonuniformity reduction control is performed every time that printing for a printing medium is completed. In contrast, when the number of ejection times of ink is equal to or greater than the threshold Th_A, the kogation nonuniformity reduction control is not performed. Accordingly, an unnecessary number of times of preliminary ejection may be reduced.

In this embodiment, a value obtained by dividing the number of ejection times of ink per printing medium by the number of ejection ports used is calculated as the average value of the number of ejection times, and the average value is stored into the EEPROM 112 every time that printing for the printing medium is performed. Then, by calculating the total sum of average values of ink since mounting of the printing head, the accumulation of the average values of the number of ejection times of ink is calculated. Control is performed such that kogation nonuniformity reduction control in each of the embodiments is not performed after a point in time at which the accumulation of the average values reaches the threshold Th_A or more.

According to this embodiment, in the case where the number of ejection times of ink since mounting of a printing head exceeds a threshold and unevenness of the density does not occur, kogation nonuniformity reduction control is caused not to be performed. Therefore, an unnecessary number of times of preliminary ejection may be reduced.

Fifth Embodiment

Figure 24:
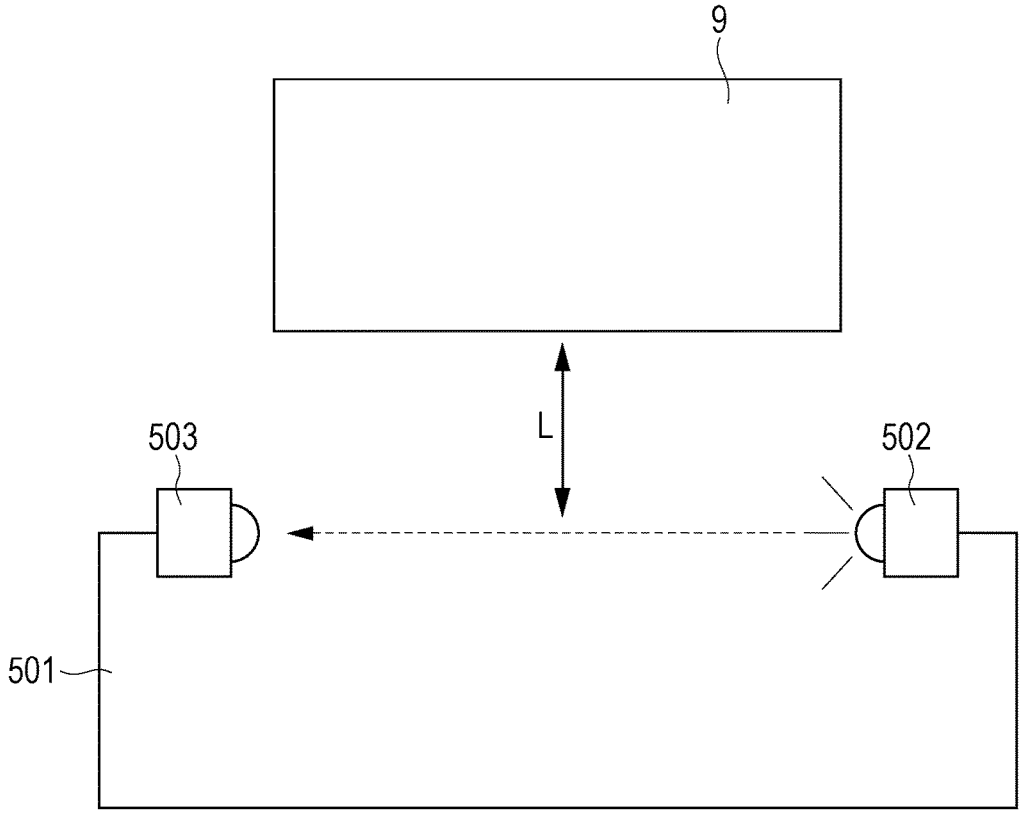
FIG. 24 is a diagram schematically illustrating a mechanism for detecting the ejection speed in an embodiment.

In a fifth embodiment, a configuration is described in which an ink jet printing apparatus includes an optical sensor 501 as a detection unit of an ejection state. In this embodiment, an optical sensor is used which includes a light emitting element 502 and a light receiving element 503 for detecting the ejection state of ink, as illustrated in FIG. 24. The optical sensor is provided below carriage scanning. After the carriage has moved to a position above the sensor, ink is ejected. Based on the time during which the carriage moves from the light emission part to the light receiving part of the sensor, the optical sensor measures the ejection speed. The ejection speed v of ink droplets is calculated using equation 3, based on a delay time T which represents a time from ejection of ink droplets from the printing head to detection of ejection by the optical sensor and a distance L from an ejection port to an optical axis of the optical sensor.

$$v = L\ (\text{mm})/T\ (\text{msec}) \qquad \text{Equation 3}$$

Referring to the graph of FIG. 10 which illustrates variations in the ejection speed, variations in the ejection speed depend on the lot of ink and manufacturing irregularities of the printing head as well as the type of ink. In this case, with the use of the ejection detection unit described above for each predetermined number of ejection times based on the accumulation of the average values defined in the fourth embodiment, the variation rate of the ejection speed may be obtained.

In this embodiment, the weighting coefficient represented by equation 1 in the first embodiment varies according to the variation rate of the ejection speed and the accumulation of the average values of the number of ejection times, based on a table illustrated in FIG. 25. That is, the weighting coefficient in the first embodiment is 0.5, whereas in this embodiment, the weighting coefficient is determined based on the variation rate of the ejection speed, the accumulation of the average values of the number of ejection times, and the table illustrated in FIG. 25.

FIG. 25 is a table for determining the weighting coefficient based on the variation rate of the ejection speed and the accumulation of the average values of the number of ejection times. The variation rate of the ejection speed is defined to be equal to a value obtained by the expression: (initial speed-speed at measurement time)/initial speed, and the weighting coefficient is determined based on the variation rate of the ejection speed and the accumulation of the average values of the number of ejection times. In this embodiment, based on the variation rate of the ejection speed and the accumulation of the average values of the number of ejection times, the value of weighting may be reduced. Therefore, an unnecessary number of times of preliminary ejection may be reduced.

In this embodiment, a configuration has been described in which a detection unit for detecting an ejection state is provided. However, this is merely an example, and a configuration and a method for calculating the speed are not limited to the above.

Sixth Embodiment

In the first to fifth embodiments, a configuration is described in which kogation is provided to a printing element which has not been used for printing by driving the printing element and nonuniformity of kogation may thus be reduced.

In a sixth embodiment, a configuration will be described in which kogation of a printing element which has been used for printing is removed by adding thermal energy to an extent in which ink is not ejected to the printing element and nonuniformity of kogation may thus be reduced.

Explanation for parts similar to those in the first to fifth embodiments described above will be omitted.

Compared to the time during which electricity is connected to a printing element at a normal ejection time, the electrical connection time is reduced, and therefore thermal energy to the printing element may be reduced. In more detail, a driving pulse including a pre-pulse and a main pulse which is applied next to the pre-pulse is applied to a printing element during normal printing, whereas processing for applying a driving pulse including a single pulse to remove kogation deposited on the surface of a printing element is performed in this embodiment. A driving pulse used to remove kogation in this embodiment may be a pulse which does not allow ejection of ink, and different pulse widths and driving voltages may be used in an appropriate manner. In the description provided below, for the sake of simplification, control for applying a driving pulse for removal of kogation even without ink ejection will be referred to as preliminary ejection.

In this embodiment, the printing modes illustrated in FIGS. 14A and 14B, FIGS. 16A and 16B, and FIG. 9 are executed as the four-pass printing mode, the six-pass printing mode, and the one-pass printing mode, as in the second embodiment. Furthermore, in this embodiment, kogation nonuniformity reduction control is executed by performing, among the steps illustrated in FIG. 12, the method for determining the number of times of preliminary ejection in step S22 in a different manner and using preliminary ejection patterns different from the preliminary ejection patterns for execution of preliminary ejection in step S24.

In step S22, the number of times of preliminary ejection is calculated using equation 4.

Number of times of preliminary ejection=dot count value/number of ejection ports used*maximum value of print permission ratios of mask patterns/average value of print permission ratios of mask patterns*number of ejection times for kogation removal/number of ejection times for kogation deposition*weighting coefficient (Equation 4)

As in the second embodiment, by dividing the dot count value by the number of ejection ports used, the average value of the number of ejection times of ink per ejection port used is calculated. Then, by dividing the average value of the number of ejection times by the average value of print permission ratios and multiplying the result by the maximum value of print permission ratios, the maximum value of the number of ejection times of ink is calculated.

Furthermore, in this embodiment, the maximum value of the number of ejection times of ink is multiplied by the value obtained by dividing the number of ejection times for kogation removal by the number of ejection times for kogation deposition, which is an experimentally calculated value. This is a value obtained by dividing the second number of times by the first number of times in the case where kogation deposited on the surface of a printing element generated when ink is ejected the first number of times may be removed by performing preliminary ejection of ink the second number of times. For example, in the case where kogation generated by ejecting ink 10,000 times is removed by applying driving pulses, which do not allow ink ejection, 1,000 times, the value obtained by dividing the number of ejection times for kogation removal by the number of ejection times for kogation deposition is 0.1.

Then, as in the second embodiment, by multiplication of the weighting coefficient, the actual number of times of preliminary ejection is determined. In this embodiment, it is understood that unevenness of the density is difficult to visually recognize when substantially half the amount of kogation deposited on a printing element that faces an ejection port which has been used for printing is removed. Therefore, a value of 0.5 is set as the weighting coefficient.

In step S24, by using a preliminary ejection pattern which corresponds to a printing mode at the time of printing in step S12, preliminary ejection of ink is performed once. In this embodiment, preliminary ejection patterns which are different from the preliminary ejection patterns used in the second embodiment illustrated in FIGS. 17A and 17B are used.

Figure 26A:
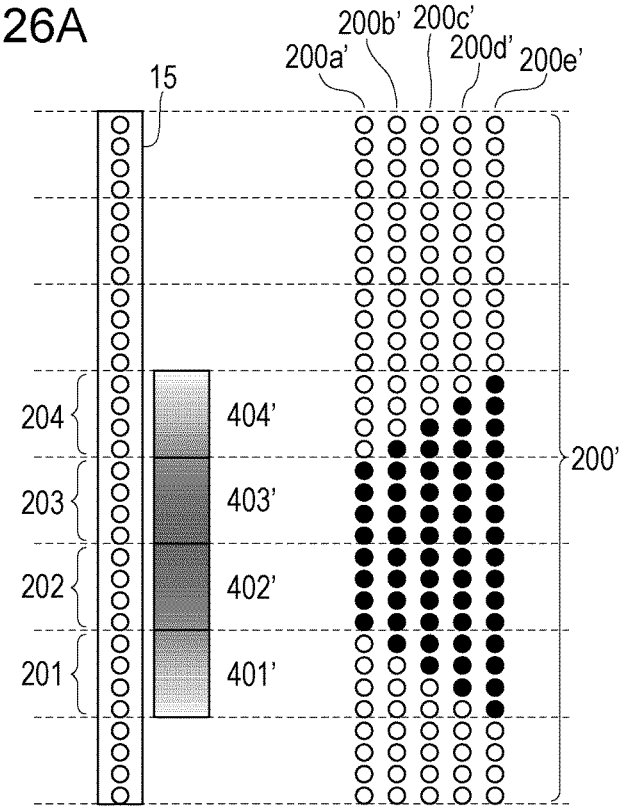
FIGS. 26A and 26B are diagrams for explaining preliminary ejection patterns in an embodiment.
Figure 26B:
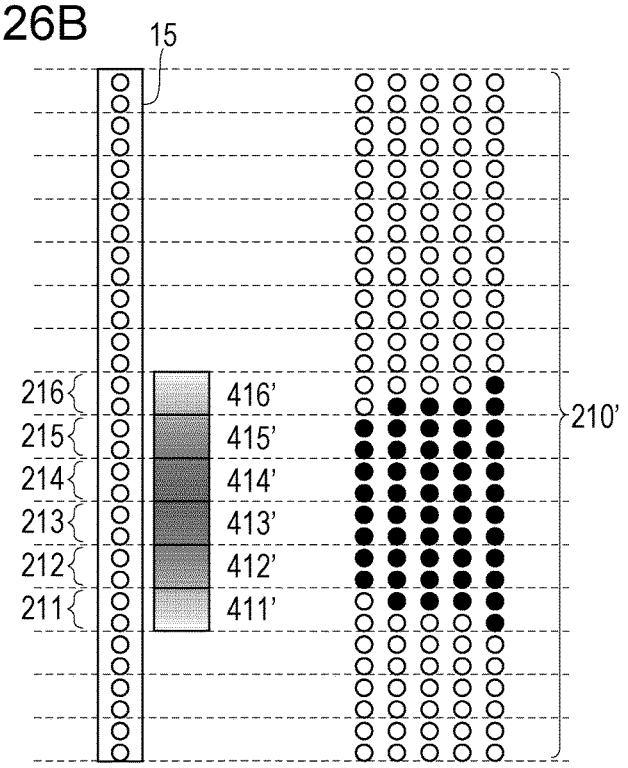

FIG. 26A is a diagram illustrating a preliminary ejection pattern 200' used in step S24 in the case where printing is performed in the four-pass printing mode. FIG. 26B is a diagram illustrating a preliminary ejection pattern 210' used in step S24 in the case where printing is performed in the six-pass printing mode. In the preliminary ejection patterns 200' and 210' illustrated in FIGS. 26A and 26B, black portion represent ejection ports from which preliminary ejection is performed, and white portions represent ejection ports from which preliminary ejection is not performed.

In this embodiment, a preliminary ejection pattern including five patterns per printing mode is set. For example, the preliminary ejection pattern 210' in the four-pass printing mode includes patterns 200*a*', 200*b*', 200*c*', 200*d*' and 200*e*'. In step S24 in this embodiment, in the case where printing is performed in the four-pass printing mode, preliminary ejection is performed by sequentially using the patterns 200*a*' to 200*e*'. In more detail, preliminary ejection is performed by using the pattern 200*a*' when the remainder obtained by dividing the counter value N by 5 is 0, using the pattern 200*b*' when the remainder is 1, using the pattern 200*c*' when the remainder is 2, using the pattern 200*d*' when the remainder is 3, and using the pattern 200*e*' when the remainder is 4.

Each of the five patterns constituting a preliminary ejection pattern in this embodiment is set such that preliminary ejection of ink is not performed from the ejection ports that have not been used for printing. In contrast, the five patterns constituting the preliminary ejection pattern in this embodiment are set such that preliminary ejection of ink is performed at least once from each of the ejection ports which have been used for printing. This is because, unlike preliminary ejection described in the first to fifth embodiments, preliminary ejection in this embodiment is application of a driving pulse, which does not allow ink ejection and is used for kogation removal, and the preliminary ejection needs to be performed for a printing element on which kogation is deposited.

The five patterns constituting a preliminary ejection pattern in this embodiment is set such that preliminary ejection of ink is always performed from an ejection port which corresponds to a mask pattern with a high print permission ratio among ejection ports which have been used for printing. This is because kogation can be removed and the amount of kogation deposited on a printing element with a large number of ejection times may not be made closer to the amount of kogation deposited on the surface of a printing element that faces an ejection port which has not been used, only when a large number of driving pulses is applied to the printing element with such a large number of ejection times at the time of printing on which a large amount of kogation is deposited.

Furthermore, the five patterns constituting a preliminary ejection pattern in this embodiment are set such that preliminary ejection of ink is performed a larger number of times from an ejection port which corresponds to a mask pattern with a higher print permission ratio among ejection ports which have been used for printing. Accordingly, the amount of kogation deposited on the surface of a printing element that faces an ejection port with a small number of ejection times among ejection ports which have been used for printing may be made closer to the amount of kogation deposited on the surface of a printing element that faces an ejection port which has not been used for printing.

For example, the patterns 200*a*' to 200*e*' are set in the four-pass printing mode such that ink is ejected from all the ejection ports other than the ejection port groups 201 to 204 within the ejection port array 15 for ejecting cyan ink that are not used for printing.

Furthermore, the patterns 200*a*' to 200*e*' are set such that ink is always ejected from the ejection port groups 202 and 203 that correspond to the mask patterns 402' and 403' with a high print permission ratio among the ejection port groups 201 to 204 used for printing.

Furthermore, the ejection port that is located on the most upstream side in the Y direction that corresponds to the pixel row L1 with the lowest print permission ratio (about 6%) of the ejection port group 201 that corresponds to the mask pattern 401' with a low print permission ratio among ejection ports used for printing, is set such that ink is ejected using the pattern 200*e*' and ink is not ejected using the patterns 200*a*', 200*b*' 200*c*' and 200*d*'. That is, with the preliminary ejection pattern 200', in the case where preliminary ejection is performed five times in step S24, preliminary ejection is performed once.

Furthermore, the ejection port that is located on the most downstream side in the Y direction which corresponds to the pixel row L4 with the highest print permission ratio (about 25%) within the ejection port group 201 that corresponds to the mask pattern 401' with a low print permission ratio among the ejection ports used for printing, is set such that ink is ejected using the pattern 200*b*', 200*c*', 200*d*' and 200*e*' and ink is not ejected using the pattern 200*a*. That is, with the preliminary ejection pattern 200', in the case where preliminary ejection is performed five times in step S24, preliminary ejection is performed four times.

The preliminary ejection pattern 210' in the six-pass printing mode is set in a manner similar to the preliminary ejection pattern 200' in the four-pass printing mode.

With the use of the method for determining the number of times of preliminary ejection of ink and the preliminary ejection patterns described above, kogation deposited on the surface of a printing element may be removed, and nonuniformity of kogation among printing elements may thus be reduced.

In this embodiment, a configuration has been described in which the number of times of preliminary ejection is determined using equation 4 in step S22 and ejection is performed only once in accordance with a pattern in a single preliminary ejecting operation in step S24. However, other configurations are also possible.

For example, in the case where printing is performed in the four-pass printing mode, ink may be ejected five times in accordance with the patterns 200*a*' to 200*e*' in a single preliminary ejecting operation in step S24. In this case, the preliminary ejecting operation in step S24 may be performed the number of times which corresponds to the value obtained by dividing the number of times of preliminary ejection of ink calculated using equation 4 by the number of ejection times per preliminary ejecting operation.

Seventh Embodiment

In a seventh embodiment, a configuration will be described in which both control for providing kogation to the surface of a printing element described in the first to fifth embodiments (hereinafter, may also be referred to as second preliminary ejection control) and control for removing kogation deposited on the surface of a printing element described in the sixth embodiment (hereinafter, may also be referred to as first preliminary ejection control) are performed.

Explanation for parts similar to those in the first to sixth embodiments described above will be omitted.

In this embodiment, as in the second embodiment, the printing modes illustrated in FIGS. 14A and 14B, FIGS. 16A and 16B, and FIG. 9 are executed as the four-pass printing mode, the six-pass printing mode, and the one-pass printing mode.

Figure 27:
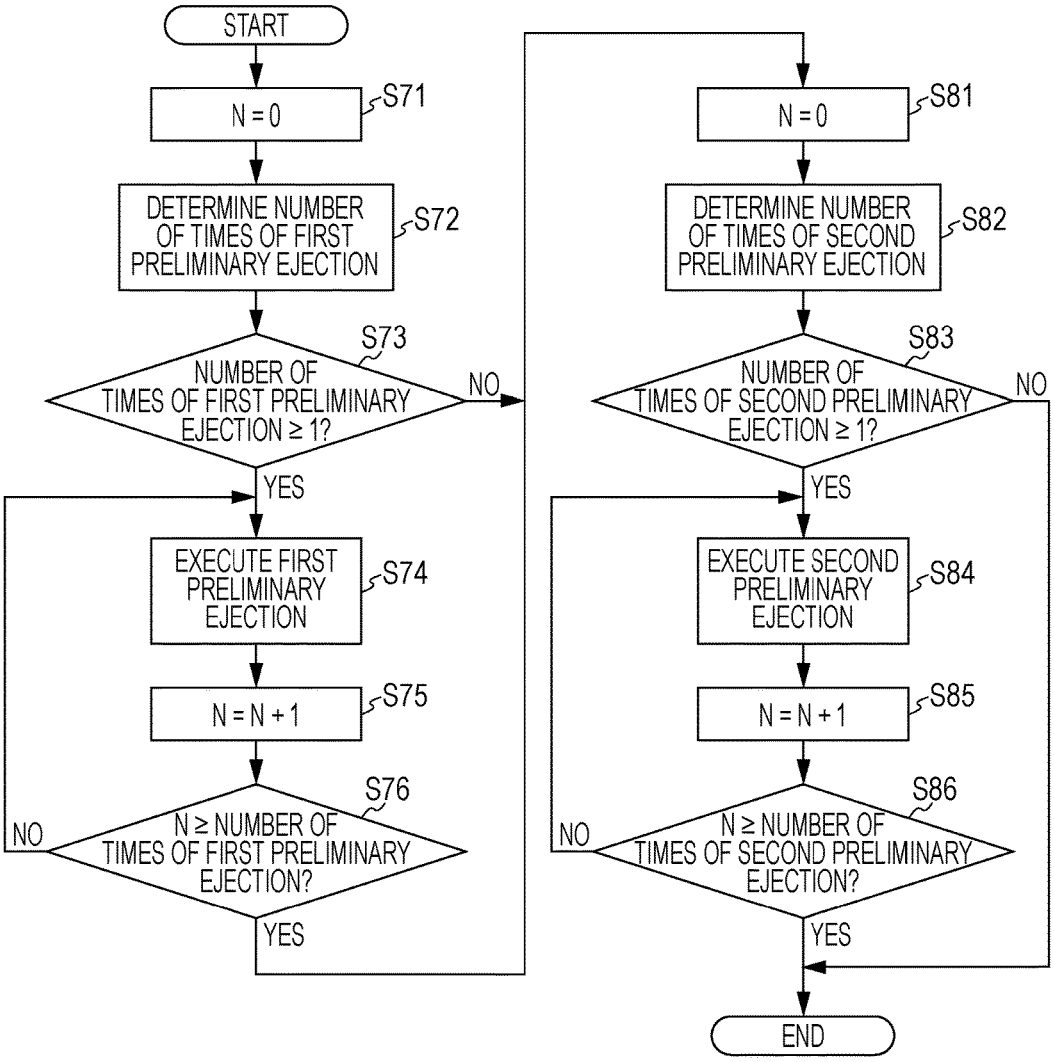
FIG. 27 is a diagram for explaining a processing process of kogation nonuniformity reduction control in an embodiment.

FIG. 27 is a flowchart of kogation nonuniformity reduction control which is performed by the CPU in accordance with a control program according to this embodiment.

In this embodiment, the kogation nonuniformity reduction control illustrated in FIG. 12 is performed in two stages.

First, in step S71, the counter value N is set to 0.

Next, in step S72, the number of times of first preliminary ejection is determined. The first preliminary ejection control is performed to remove kogation deposited on the surface of a printing element which has been used for printing and is implemented by applying a driving pulse, which does not allow ink ejection, to a printing element which has been used for printing. The number of times of first preliminary ejection is calculated using equation 5.

Number of times of first preliminary ejection=dot count value/number of ejection ports used*maximum value of print permission ratios of mask patterns/average value of print permission ratios of mask patterns*number of ejection times for kogation removal/number of ejection times for kogation deposition*weighting coefficient*preliminary ejection coefficient (Equation 5)

The method is the same as the method for calculating the number of times of preliminary ejection using equation 4 in the sixth embodiment with the exception of further multiplication of a preliminary ejection coefficient. The preliminary ejection coefficient is a value regarding the ratio to which the first preliminary ejection control (kogation removal control) of the kogation nonuniformity reduction control in this embodiment contributes. For example, in the case where the first preliminary ejection control and the second preliminary ejection control (kogation deposition control), which will be described later, are performed with the proportion of 50% and 50%, respectively, to reduce nonuniformity of kogation, the preliminary ejection coefficient is 0.5. Furthermore, in the case where the first preliminary ejection control and the second preliminary ejection control are performed with the proportion of 30% and 70%, respectively, to reduce nonuniformity of kogation, the preliminary ejection coefficient is 0.3. Furthermore, in the case where the first preliminary ejection control and the second preliminary ejection control are performed with the proportion of 95% and 5%, respectively, to reduce nonuniformity of kogation, the preliminary ejection coefficient is 0.95.

Next in step S73, it is determined whether or not the number of times of first preliminary ejection determined in step S72 is one or more. When the number of times of first preliminary ejection is less than one, the first preliminary ejection control ends. When the number of times of first preliminary ejection is one or more, the process proceeds to step S74.

In step S74, the first preliminary ejection is performed once by using a preliminary ejection pattern corresponding to the printing mode at the time of printing in step S72. In the first preliminary ejection in this embodiment, the preliminary ejection patterns 200' and 210' illustrated in FIGS. 26A and 26B are used, and driving pulses, which do not allow ink ejection, are applied, as in the sixth embodiment.

Next, in step S75, the counter value N is incremented by one. The counter value is set to 0 in step S71, and therefore the counter value N is increased to 1 in step S75.

Next, in step S76, it is determined whether or not the counter value N is equal to or more than the number of times of first preliminary ejection determined in step S72. When the counter value N is equal to or more than the number of times of first preliminary ejection, since the first preliminary ejecting operation has been performed in step S74 the number of times corresponding to the number of times of first preliminary ejection determined in step S72, the process proceeds to step S81. In contrast, when the counter value N is less than the number of times of first preliminary ejection, the process returns to step S74, and the first preliminary ejecting operation is performed again.

Then, the processing of steps S74 to S76 is repeatedly performed, and similar control is performed until it is determined in step S76 that the counter value N is equal to or more than the number of times of first preliminary ejection determined in step S72 and the process proceeds to step S81.

Next, the counter value N is reset to 0 in step S81.

Next, in step S82, the number of times of second preliminary ejection is determined. The second preliminary ejection control is performed to provide kogation to the surface of a printing element which has not been used for printing, and is implemented by ejecting ink from a printing element which has not been used for printing. The number of times of second preliminary ejection is calculated using equation 6.

Number of times of second preliminary ejection=dot count value/number of ejection ports used*maximum value of print permission ratios of mask patterns/average value of print permission ratios of mask patterns*weighting coefficient*(1-preliminary ejection coefficient) (Equation 6)

The method is the same as the method for calculating the number of times of preliminary ejection using equation 2 in the second embodiment with the exception of further multiplication of a difference between 1 and a preliminary ejection coefficient. As described above, the preliminary ejection coefficient is a value regarding the ratio to which the first preliminary ejection control (kogation removal control) of the kogation nonuniformity reduction control contributes. Therefore, since the ratio to which the second preliminary ejection control (kogation deposition control) of the kogation nonuniformity reduction control contributes is obtained by subtracting the preliminary ejection coefficient from 1, further multiplication of the difference between 1 and the preliminary ejection coefficient is performed.

Next, in step S83, it is determined whether or not the number of times of second preliminary ejection determined in step S82 is one or more. When the number of times of second preliminary ejection is less than one, the kogation nonuniformity reduction control ends. When the number of times of second preliminary ejection is one or more, the process proceeds to step S84.

In step S84, the second preliminary ejection is performed once by using a preliminary ejection pattern corresponding to the printing mode at the time of printing in step S82. In the second preliminary ejection in this embodiment, ejection of ink which does not contribute to printing of an image is performed as in the second embodiment, by using the preliminary ejection patterns 200 and 210 illustrated in FIGS. 17A and 17B.

Next, in step S85, the counter value N is incremented by one. The counter value N is reset to 0 in step S81, and therefore the counter value N is increased to 1 in step S85.

Next, in step S86, it is determined whether or not the counter value N is equal to or more than the number of times of second preliminary ejection determined in step S82. When it is determined that the counter value N is equal to or more than the number of times of second preliminary ejection, since the second preliminary ejecting operation has been performed in step S84 the number of times corresponding to the number of times of second preliminary ejection determined in step S82, the second preliminary ejection control ends, and the kogation nonuniformity reduction control ends. In contrast, when the counter value N is less than the number of times of second preliminary ejection, the process returns to step S84, and the second preliminary ejecting operation is performed again.

Then, the processing of steps S84 to S86 is repeatedly performed, and similar control is performed until it is determined in step S86 that the counter value N is equal to or more than the number of times of second preliminary ejection determined in step S82.

With the configuration described above, by performing both the control for providing kogation and the control for removing kogation, nonuniformity of kogation among printing elements may be reduced.

In this embodiment, a configuration has been described in which the first preliminary ejection control (kogation removal control) is performed and then the second preliminary ejection control (kogation deposition control) is performed. However, a configuration in which the second preliminary ejection control is performed and then the first preliminary ejection control is performed is also possible.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In each of the foregoing embodiments, a configuration has been described in which printing for a single printing medium is completed and then kogation nonuniformity reduction control is performed. However, other configurations are also possible. For example, kogation nonuniformity reduction control may be performed every time that printing for three printing media is completed. Furthermore, kogation nonuniformity reduction control may be performed for each job received at the ink jet printing apparatus. For example, advantages of the present invention may also be achieved with a configuration in which kogation nonuniformity reduction control is performed every time that printing for a job is completed.

Furthermore, in each of the foregoing embodiments, a configuration has been described in which kogation nonuniformity reduction control is performed only for an ejection port array for ejecting cyan ink among a plurality of ejection port arrays. However, other configurations are also possible. For example, in the case where kogation may remarkably occur at all of the plurality of ejection port arrays, kogation nonuniformity reduction control may be performed for all the ejection port arrays.

Furthermore, in each of the foregoing embodiments, a configuration has been described in which printing is performed by performing a plurality of scanning operations for a unit region on a printing medium. However, a configuration in which printing is performed only by a single scanning operation for a printing medium is also possible.

According to an ink jet printing apparatus and an ink jet printing method according to the present invention, in the case where printing is performed by driving only some of a plurality of printing elements within a printing element array, nonuniformity of kogation among the printing elements may be reduced while the load of data processing being reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-102292, filed May 19, 2015, which is hereby incorporated by reference herein in its entirety.

What is claimed is:

1. An ink jet printing apparatus that prints an image by ejecting ink to a printing medium, comprising:

a printing head configured including a printing element array in which a plurality of printing elements for generating thermal energy for ejecting ink are arranged in a predetermined direction and ejection ports for ejecting ink corresponding to the plurality of printing elements;

a scanning unit configured to cause the printing head to perform scanning for a unit region on the printing medium relatively in a cross direction which crosses the predetermined direction;

a selection unit configured to select one of a plurality of printing modes which include at least a first printing mode in which printing is performed by driving first printing elements which constitute a part of the plurality of printing elements arranged in the printing element array and not driving second printing elements which constitute the other part of the plurality of printing elements arranged in the printing element array;

a print ejecting unit configured to cause the printing head to eject ink for forming an image on the unit region by driving printing elements in accordance with the selected printing mode, with the scanning of the printing head;

a first acquisition unit configured to acquire information regarding the number of driving times of the first printing elements in the printing by the printing unit; and a preliminary ejecting unit configured to cause the printing head to eject ink by driving the second printing elements while ejection of ink by the print ejecting unit is not performed, in a case where the first printing mode is selected by the selection unit, ejecting by the preliminary ejecting unit not contributing to printing the image, wherein the preliminary ejecting unit (i) ejects ink by driving the second printing elements at a first number of times, in a case where the number of driving times indicated by the acquired information is a second number of times, and (ii) ejects ink by driving the second printing elements at a third number of times that is larger than the first number of times, in a case where the number of driving times indicated by the acquired information is a fourth number of times that is larger than the second number of times.

2. The ink jet printing apparatus according to claim 1, wherein the first printing elements are arranged continuously in the predetermined direction within the printing element array, and wherein the second printing elements include at least printing elements which are arranged on one end portion in the predetermined direction within the printing element array and arranged continuously in the predetermined direction.

3. The ink jet printing apparatus according to claim 2, wherein the first printing mode is a printing mode in which third printing elements which are arranged between the first printing elements and the second printing elements in the predetermined direction and arranged continuously in the predetermined direction are further driven, and wherein the preliminary ejecting unit ejects ink by further driving the third printing elements when ejection of ink by the ejecting unit is not performed.

4. The ink jet printing apparatus according to claim 3, further comprising:

a second acquisition unit configured to acquire image data which corresponds to the image to be printed in the unit region; and a generation unit configured to generate a plurality of pieces of printing data which correspond to a plurality of scanning operations, based on the acquired image data and a plurality of mask patterns which correspond to the plurality of scanning operations, in a case where the first printing mode is selected by the selection unit, wherein the ejecting unit ejects ink based on the plurality of pieces of printing data in the corresponding scanning operations by the scanning unit.

5. The ink jet printing apparatus according to claim 4, wherein the image data defines ejection or non-ejection of ink for each of a plurality of pixels in the unit region, and wherein the plurality of mask patterns each define permission or non-permission of ejection of ink to each of the plurality of pixels within the unit region.

6. The ink jet printing apparatus according to claim 5, wherein the number of pixels for which ejection of ink is permitted in a first mask pattern which corresponds to the first printing elements among the plurality of mask patterns is greater than the number of pixels for which ejection of ink is permitted in a second mask pattern which corresponds to the third printing elements among the plurality of mask patterns, and wherein in a case where the first printing mode is selected by the selection unit, the preliminary ejecting unit ejects ink by driving the second printing elements and the third printing elements in such a manner that the number of driving times of the second printing elements is greater than the number of driving times of the third printing elements.

7. The ink jet printing apparatus according to claim 6, wherein the number of pixels for which ejection of ink is permitted in a region which corresponds to the third printing element which is arranged at a first position in the predetermined direction among the third printing elements within the second mask pattern is greater than the number of pixels for which ejection of ink is permitted in a region which corresponds to the third printing element which is arranged at a second position further away from the first printing elements and closer to the second printing elements than the first position in the predetermined direction among the third printing elements within the second mask pattern.

8. The ink jet printing apparatus according to claim 7, wherein in a case where the first printing mode is selected by the selection unit, the preliminary ejecting unit ejects ink by driving the second printing elements and the third printing elements in such a manner that the number of driving times of the third printing element which is arranged at the second position is greater than the number of driving times of the third printing element which is arranged at the first position.

9. The ink jet printing apparatus according to claim 1, wherein the preliminary ejecting unit does not drive the first printing elements when ejection of ink by the ejecting unit is not performed, in a case where the first printing mode is selected by the selection unit.

10. The ink jet printing apparatus according to claim 1, wherein the plurality of printing modes further includes a second printing mode in which printing is performed by driving at least the first printing elements and the second printing elements, and wherein the preliminary ejecting unit does not eject ink by not driving the first driving elements and the second printing elements when ejection of ink by the ejecting unit is not performed, in a case where the second printing mode is selected by the selection unit.

* * * * *